US007141935B2

(12) United States Patent
Ushijima et al.

(10) Patent No.: US 7,141,935 B2
(45) Date of Patent: Nov. 28, 2006

(54) INVERTER CIRCUIT FOR SURFACE LIGHT SOURCE SYSTEM

(75) Inventors: Masakazu Ushijima, Nakano (JP); Minoru Kijima, Ota (JP)

(73) Assignees: Masakazu Ushijima, Tokyo (JP); Hong-Fei Chen, Taichung (TW)

( * ) Notice: Subject to any disclaimer, the term of this patent is extended or adjusted under 35 U.S.C. 154(b) by 0 days.

(21) Appl. No.: 10/968,947

(22) Filed: Oct. 21, 2004

(65) Prior Publication Data

US 2005/0088113 A1 Apr. 28, 2005

(30) Foreign Application Priority Data

Oct. 24, 2003 (JP) ..... 2003-365326

(51) Int. Cl.

| | |
|---|---|
| ***F02P 15/00*** | (2006.01) |
| ***H05B 37/02*** | (2006.01) |
| ***H05B 39/04*** | (2006.01) |
| ***H05B 41/00*** | (2006.01) |
| ***H05B 41/36*** | (2006.01) |

(52) U.S. Cl. ..... 315/209 T; 315/276

(58) Field of Classification Search ..... 315/184, 315/196, 220–224, 209 T, 251, 254, 255, 315/264, 276, 312

See application file for complete search history.

(56) References Cited

U.S. PATENT DOCUMENTS

| | | | | |
|---|---|---|---|---|
| 5,309,062 | A * | 5/1994 | Perkins et al. | 315/53 |
| 5,495,405 | A | 2/1996 | Fujimara et al. | 363/133 |
| 5,786,670 | A * | 7/1998 | Nguyen | 315/200 R |
| 6,222,326 | B1 * | 4/2001 | Moisin | 315/209 R |
| 6,239,557 | B1 * | 5/2001 | Chang et al. | 315/278 |
| 6,366,029 | B1 * | 4/2002 | Billings | 315/244 |
| 6,483,260 | B1 * | 11/2002 | Flory, IV | 315/325 |
| 6,570,344 | B1 * | 5/2003 | Lin | 315/224 |
| 6,667,585 | B1 * | 12/2003 | O'Meara | 315/291 |
| 6,949,890 | B1 * | 9/2005 | Chou et al. | 315/294 |
| 2002/0140538 | A1 * | 10/2002 | Yer et al. | 336/198 |
| 2004/0232853 | A1 * | 11/2004 | Hur et al. | 315/291 |

FOREIGN PATENT DOCUMENTS

| | | |
|---|---|---|
| JP | 2727461 B2 | 12/1997 |
| JP | 2727462 B2 | 12/1997 |
| JP | 10-092589 A | 4/1998 |
| JP | 2733817 B2 | 9/1998 |
| JP | 2000-138097 A | 5/2000 |

* cited by examiner

*Primary Examiner*—Wilson Lee
*Assistant Examiner*—Marie Antoinette Cabucos
(74) *Attorney, Agent, or Firm*—Birch, Stewart, Kolasch & Birch, LLP

(57) ABSTRACT

An inverter circuit for discharge lamps, in which transformers are separated into multiple small or middle-sized transformers connected to one another to provide a high-power transformer equivalent to a large transformer. The inverter circuit includes a plurality of leakage flux step-up transformers each having a magnetically continuous central core, a primary winding, and a distributed-constant secondary winding, wherein a part of a resonance circuit is formed among a leakage inductance produced on the secondary winding side, a distributed capacitance of the secondary winding and a parasitic capacitance produced around a discharge lamp close to a proximity conductor, and as the resonance circuit resonates, the secondary winding has a close coupling portion in a vicinity of the primary winding which has a magnetic phase close to that of the primary winding and magnetically close couples with the primary winding.

9 Claims, 20 Drawing Sheets

$k_n$: SERIES CAPACITANCE BETWEEN n-TH DISK AND (n+1)-TH DISK $C_n$: CAPACITANCE TO GROUND OF n-TH DISK $M_{ns}$: MUTUAL INDUCTANCE BETWEEN n-TH DISK AND s-TH DISK

INVERTER CIRCUIT FOR SURFACE LIGHT SOURCE SYSTEM

This application claims priority to Japanese Patent application No 2003-365326 filed on Oct. 24, 2003.

TECHNICAL FIELD

The present invention relates to an application of the invention described in Japanese Patent Application No. 2004-003740 (corresponding to U.S. Ser. No. 10/773,230) and pertains to an inverter circuit for discharge lamps, such as a cold-cathode fluorescent lamp, an external electrode cold-cathode fluorescent lamp, and a neon lamp, and an inverter circuit for a high-power surface light source system which emits light using multiple discharge lamps.

BACKGROUND OF THE INVENTION

Recently, the use of multiple cold-cathode fluorescent lamps in a surface light source such as a liquid crystal display backlight becomes popular, which demands a high-power inverter circuit.

A high-power inverter circuit is generally realized by enlarging a step-up transformer and its drive circuit. Because even a slight power loss in a high-power inverter circuit leads to generation of large heat, a high efficiency inverter circuit is needed.

The present inventor has proposed in U.S. Pat. No. 5,495,405 (corresponding to Japanese Patent No. 2733817), as a high efficiency (a highly efficient) inverter circuit, a leakage flux transformer inverter circuit which utilizes an effect of improving the power factor as a result of reducing the exciting current flowing across the primary winding of a step-up transformer by resonating the secondary side circuit thereof.

Those high efficiency inverter circuits have been used as inverter circuits for notebook type personal computers with aims of making inverter circuits compact and highly efficient. Such an inverter circuit for a notebook type personal computer requires one leakage flux transformer and a resonance circuit on the secondary side per each cold-cathode fluorescent lamp, and has power of 5 W or so at a maximum.

Multiple cold-cathode fluorescent lamps are used in a surface light source such as a liquid crystal display backlight, and there is a demand of making the power of the associated inverter circuit greater accordingly.

There are multiple proposals on inverter circuits for high-power multi-lamp surface light sources. Many of the inverter circuits use multiple collector resonating circuits which are often used in the conventional inverter circuits. In one of the proposals, a single small leakage flux transformer is provided per two cold-cathode fluorescent lamps as shown in FIG. 2 for the purpose of reducing the overall cost for the inverter circuit.

When one wants a higher efficiency, however, it is effective to resonate the secondary side circuit as disclosed in U.S. Pat. No. 5,495,405. In this case, the collector resonating circuit and the resonance circuit present in the primary circuit interfere with each other, making it very difficult to adjust the circuit constant.

Since the exciting current which flows across the primary winding is used as the resonance current from the resonance circuit on the primary side according to the principle of the collector resonating circuit, the effect of improving the power factor cannot be utilized to a certain extent when the invention described in U.S. Pat. No. 5,495,405 invention is achieved by collector resonating circuits. In this respect, another exciting circuit or so which can extremely reduce the exciting current is frequently used.

In either case, those inverter circuits are each designed merely in such a way that multiple small high efficiency inverter circuits are laid out in proportion to the number of cold-cathode fluorescent lamps, and are thus complicated.

It is the step-up transformer and the drive circuit in the inverter circuit for a high-power surface light source that require the cost most, so that the required use of the step-up transformer and the drive circuit causes the overall cost for the inverter circuit to increase.

While it is necessary to achieve cost reduction for an inverter circuit for discharge lamps by reducing the number of step-up transformers and drive circuits by making the power of the step-up transformers greater, it is difficult to drive cold-cathode fluorescent lamps in parallel.

The difficulty arises from the following reason. A cold-cathode fluorescent lamp has a negative impedance characteristic such that the voltage falls as the current increases. Even with an attempt to drive cold-cathode fluorescent lamps in parallel, therefore, when one of the parallel-connected cold-cathode fluorescent lamps is lighted, this cold-cathode fluorescent lamp lighted first drops the lamp voltages of the other cold-cathode fluorescent lamps connected in parallel. As a consequence, all the cold-cathode fluorescent lamps except for the cold-cathode fluorescent lamp that is lighted first are not lighted.

As a solution to this problem, a scheme of stably driving multiple cold-cathode fluorescent lamps in parallel has been proposed by the present inventor in U.S. Ser. No. 10/773,230 (corresponding to Japanese Patent Application No. 2004-003740) as shown in FIG. 3, in addition to the suggested use of cold-cathode fluorescent lamps which can be lighted in parallel, such as an external electrode fluorescent lamp (EEFL).

As parallel driving of multiple cold-cathode fluorescent lamps becomes possible, a high-power step-up transformer becomes necessary to drive the transformers. In an inverter circuit for discharge lamps, like cold-cathode fluorescent lamps, which require a high voltage, it is very difficult to make the power of the step-up transformer higher for the following reason.

First, increasing the power of the step-up transformer requires that the transformer should be made larger. This naturally increases the thickness of the transformer, which is not allowed to become too thick due to the particular demand of designing liquid crystal display backlights thinner besides compactness.

Because the shape of the transformer greatly influences the parameters thereof and the relationship between the cross-sectional area of the magnetic path and the length of the magnetic path should be kept at a constant ratio, however, the shape of the transformer does not have a high degree of freedom. When a thinner design is sought out, the length of the magnetic path should be greater than the cross-sectional area of the magnetic path. This leads to a smaller coupling coefficient k of the transformer, resulting in a larger value of the leakage inductance $L_e$ (as defined by The Institute of Electrical Engineers of Japan (IEEJ)) to the self-inductance $L_o$. The term "leakage inductance" defined in books published by IEEJ differs from the same term "leakage inductance" obtained by the JIS measuring method. To distinguish the leakage inductances, therefore, the former leakage inductance is called "leakage inductance $L_e$ (IEEJ)", and the latter is called. "leakage inductance $L_s$ (JIS)". Both leakage inductances can be mutually converted by an equation given below.

The leakage inductances have the following relationship.

The leakage inductance $L_e$ (IEEJ) is given by $$L_e=(1-k)\cdot L_o.$$

The mutual inductance M is given by $$M=k\cdot L_o.$$

The leakage inductance $L_s$ (JIS) is given by $$L_s = \frac{1}{\frac{1}{L_e}+\frac{1}{M}} + L_e$$

It is apparent that as the leakage inductance $L_e$ (IEEJ) increases, the leakage inductance $L_s$ (JIS), which is an important parameter to constitute a resonance circuit on the secondary winding side, becomes larger.

In constructing a high efficiency inverter circuit described in U.S. Pat. No. 5,495,405, it is desirable that the leakage inductance $L_s$ (JIS) should have the following relationship with the impedance $Z_r$ of the discharge lamp.

$$|X_{L_s}| \leq |Z_r|$$

This means that a high efficiency inverter circuit can be realized when the reactance of the leakage inductance $L_s$ (JIS) at the operational frequency of the inverter circuit is nearly equal to or slightly smaller than the impedance of the discharge lamp. This relational equation applies effectively to an inverter circuit for a large surface light source as well as to an inverter circuit for a notebook type personal computer.

If multiple cold-cathode fluorescent lamps are driven in parallel with an increase in the power of the surface light source, therefore, impedance $Z_r$ of the discharge lamp is the impedance of the cold-cathode fluorescent lamps divided by the number of the cold-cathode fluorescent lamps and is thus a small value. The relationship between the leakage inductance $L_s$ (JIS) and the impedance $Z_r$ indicates that a high efficiency inverter circuit can be realized when the reactance of the leakage inductance $L_s$ (JIS) at the operational frequency of the inverter circuit is equal to or slightly smaller than the impedance of the discharge lamp. This means that the leakage inductance $L_s$ (JIS) needed for transformers for a high-power inverter circuit should be small.

When the shape of the step-up transformer is restricted so as to match with the flat shape actually demanded for a liquid crystal display backlight, however, the leakage inductance $L_s$ (JIS) should become large as explained above. It is very difficult to design a flat and high-power transformer.

Another important factor is the speed of a progressive wave which is generated on the secondary winding. First, as the shape of the transformer becomes larger with an increase in power, the self-resonance frequency of the secondary winding becomes lower. The self-resonance frequency of the secondary winding in the inverter circuit for cold-cathode fluorescent lamps is associated with the step-up effect and is therefore an important parameter. The relationship will be described in detail below.

The windings of a transformer are in a state of a distributed-constant as shown in FIG. 4 in a detailed illustration including the influence of the distributed capacitance. The influence of the distributed constant of the windings is analyzed in detail as a countermeasure against breakdown of a power transformer originated from the lightening surge as described in, for example, "Transformer in Power Device Course 5" (published by The Nikkan Kogyo Shimbun, Ltd.). It is known from the literature that the windings of a transformer form a delay circuit having a specific distributed constant. The influence of such a property appears noticeably when multiple very thin wires are wound up as done for the secondary winding of a step-up transformer for cold-cathode fluorescent lamps.

In the actual step-up transformer for cold-cathode fluorescent lamps, the distributed constant of the secondary winding appears around the self-resonance frequency or at a frequency higher than the self-resonance frequency. As the secondary winding forms a delay circuit, transmission delay of the energy occurs from that portion of the secondary winding which is close to the primary winding to that portion of the secondary winding which is far from the primary winding, as shown in FIGS. 5 to 7. This phenomenon is so-called phase-shift or phase modification wherein the phase is delayed gradually. The term "phase modification" is known in the field of motors or the like.

The phase modification in the present invention is called "phase-modifying transformer" by Electrotechnical Laboratory (currently, National Institute of Advanced Industrial Science and Technology) when authorized to do a subsidized research of Kanto Bureau of International Trade and Industry in Ministry of International Trade and Industry (currently, Kanto Bureau of Economy, Trade and Industry) in 1996. The phase modification phenomenon results in that the current phase of that portion of the secondary winding which is close to the primary winding becomes close to the current phase of the primary winding, so that a large portion of the flux generated on the primary winding penetrates the secondary winding, thus forming a close coupling portion, as shown in FIG. 8.

This structure noticeably appears in the vicinity of the frequency at which the leakage inductance $L_s$ (JIS) of the secondary winding and the capacitive component on the secondary side resonate, but does not appear when no resonance takes place.

Therefore, the resonance of the leakage inductance $L_s$ (JIS) of the secondary winding and the capacitive component on the secondary side is essential in the appearance of the structure of close coupling and loose coupling.

The current phase of the portion of the secondary winding which is far from the primary winding is delayed from the current phase of the primary winding, so that a large portion of flux leaks from the secondary winding, thus forming a loose coupling portion. At the loose coupling portion, as shown in FIG. 8, most of the flux that has penetrated from the primary winding leaks, so that the leakage flux leaks differently from that in the prior art and, even with the same leakage inductance, a larger amount of flux leaks at the loose coupling portion than that in the prior art. That is, a so-called extreme leakage flux is produced. (In FIGS. 5 to 8, not only 100% of the magnetic flux or more leaks, but also 35% of a magnetic flux of the opposite phase is generated.) Such flux leakage phenomenon differs from the behavior of the leakage flux in the prior art. FIG. 9 shows the behavior of the leakage flux in the conventional transformer illustrated for readers' reference.

As a signal which travels on the secondary winding with a distributed constant has a given propagation speed due to such a phase delay phenomenon, the signal has a given wavelength from the relationship with the drive frequency. The propagation speed is about several Km/sec for a transformer in an inverter circuit for cold-cathode fluorescent lamps. Consequently, a progressive wave is generated on the secondary winding of the transformer in the inverter circuit. Given that the wavelength of the progressive wave is λ, when the wavelength of ¼λ coincides with the physical length of the bobbin of the secondary winding, a resonance phenomenon similar to the resonance of an antenna or the resonance of an acoustic resonant body as shown in FIG. 10 occurs. In this case, the resonance frequency of ¼λ is the self-resonance frequency of the secondary winding itself, so that the resonance frequency of ¼λ can be known by actually measuring the self-resonance frequency of the secondary winding of the transformer.

In the general knowledge, the step-up ratio of the transformer becomes greater as the transformation ratio becomes larger. On the contrary, detailed observations show that such is not true at a frequency close to the self-resonance frequency. The transformer shows the maximum step-up operation at a frequency at which the self-resonance frequency, which is the resonance frequency of the self-inductance of the secondary winding and the distributed capacitance of the secondary winding (parasitic capacitance between windings), becomes equal to the operational frequency of the inverter. That frequency is the resonance frequency of ¼λ.

When the self-resonance frequency becomes lower than the operational frequency of the inverter, the transformer gradually loses the step-up operation. When the self-resonance frequency further drops and becomes a half the operational frequency of the inverter, the transformer does not make the step-up operation at all. This is because at the resonance frequency of ½λ, the current phase of the secondary winding at a far end portion which is apart from the primary winding is delayed by 180 degrees from, and becomes opposite to, the current phase of that portion of the secondary winding which is close to the primary winding.

When the self-resonance frequency becomes lower than the operational frequency of the inverter, various phenomena, such as suppression of the step-up operation and generation of a voltage of the opposite phase, may occur. In the general knowledge, however, the step-up operation has not been thought in such a concept.

That is, it is the conventional knowledge that the transformation ratio should simply be increased to gain the step-up ratio, so that an insufficient step-up ratio when pointed out is coped with winding the secondary winding more.

This measure however leads to excessive winding of the secondary winding, which often results in a lower self-resonance frequency of the secondary winding. Although the step-up ratio may be repressed due to the excessive winding of the secondary winding, it is often the case that when the proper step-up ratio is not obtained, an attempt is made to wind the secondary winding more to gain the step-up ratio. The excessive winding of the secondary winding, further lowers the self-resonance frequency. This results in a vicious circle of suppressing the step-up ratio more. As apparent from the above, the self-resonance frequency of the secondary winding of the transformer has a significance in the step-up transformer for cold-cathode fluorescent lamps and care should be taken not to make the self-resonance frequency too low.

From the viewpoint of the coupling coefficient, the self-resonance frequency can be set high to a certain degree by increasing the number of sections of the secondary winding of the transformer. Setting the number of sections larger means that the coupling coefficient becomes smaller and the leakage inductance becomes larger.

Because the impedance of a load to be driven in a high-power inverter circuit is low, the leakage inductance in a high-power transformer should be made smaller in proportion to the load. Therefore, there is a limit to increasing the number of sections. As the transformer becomes larger, the self-resonance frequency inevitably becomes lower, so that contradictory conditions should be satisfied to reduce the leakage inductance and acquire a transformer with a high self-resonance frequency. Needless to say, designing the transformer is difficult.

The secondary winding of the transformer has a distributed constant and forms a delay circuit. The secondary winding therefore has a characteristic impedance from the theory of a high-frequency transmission circuit. To form the ideal close coupling portion/loose coupling portion structure, the characteristic impedance which is determined by the size of the bobbin of the transformer, the cross-sectional area of the core, the magnetic path and the winding of the secondary winding should be matched with the impedance of the load of the discharge lamp.

Without impedance matching, an echo is generated, so that the ideal delayed waveform is not acquired, resulting in generation of a standing wave. As a result, the leakage flux on the secondary winding does not become uniform, disabling the achievement of the ideal conditions to ultimately minimize the core loss.

To reduce heat generated in a high-power transformer, the copper loss and the core loss should be minimized. However, with a requirement of a flat shape added to the difficult requirement that three conditions of the leakage inductance, the speed of the progressive wave (i.e., the self-resonance frequency) and the characteristic impedance should be met, it becomes harder to design a transformer which satisfies all the conditions at a time.

Several attempts have been made to achieve a high-power step-up transformer by connecting a plurality of transformers in parallel.

FIG. 18 shows an example of a discharge lamp which is driven with a pulse signal and is disclosed in Japanese Laid-Open Patent Publication (Kokai) No. 2000-138097.

In the example, an attempt is made to realize a high-power step-up circuit by connecting both the primary windings and the secondary windings of a transformer which drives a discharge lamp to be driven with a pulse signal. In particular, a pulse transformer requires that the leakage inductance should be particularly small because a large leakage inductance disables the supply of a sharp pulse with a large value of di/dt.

Generally speaking, however, when transformers with very small flux leakage are connected in parallel, the current may flow between the secondary windings of the transformers and reduce the efficiency or heat may be generated due to variations in the characteristics of the individual transformers. In this respect, the example disclosed in Japanese Laid-Open Patent Publication (Kokai) No. 2000-138097 uses resistor components of the secondary windings of the transformers to disperse the load evenly over the individual transformers.

That is, the parallel connection of transformers essentially requires the reactance for parallel connection. With insufficient reactance, the load to be dispersed over the transformers does not become uniform, so that when multiple transformers are connected, the load is concentrated on some transformers.

When the reactance is given by a resistor component, reduction in efficiency by the generation of the Joule heat should be taken into consideration.

When a discharge lamp is driven with a sine wave of 40 KHz to 100 KHz as done for a cold-cathode fluorescent lamp, the leakage inductance larger than that needed for pulse driving is required to acquire the reactance for parallel connection. Conventionally, in the case of driving a cold-cathode fluorescent lamp, ballast capacitors are often connected in series as the ballast reactance. The step-up transformer in this case does not use the resonance of the secondary side circuit as used in U.S. Pat. No. 5,495,405. The transformers to be used in this case have a small leakage inductance and are of course unsuitable for parallel connection. In addition, the transformation ratio of transformers which are not resonated reflects on the step-up ratio directly, so that for parallel connection, the step-up ratio should be controlled strictly so as to have no variation.

FIG. 19 shows an example of parallel connection disclosed in Japanese Laid-Open Patent Publication (Kokai) No. H10-92589, where the transformer has a small leakage inductance and the secondary side circuit is not resonated. In this case, when the secondary windings of the transformers are connected in parallel, the current that flows between the secondary windings may increase, generating heat.

To acquire parallel connection of transformers having small leakage inductance, therefore, a practical inverter circuit is difficult to design unless the parallel connection is made via ballast capacitors as shown in FIG. 20.

SUMMARY OF THE INVENTION

It is hard to realize a high-power transformer by a single large transformer, and the present invention aims at providing a high-power transformer equivalent to a large transformer by separating transformers into plural small or middle-sized transformers and connecting the separated transformers to one another.

It is another object of the present invention to achieve a scheme of acquiring a high efficiency by using the secondary side circuit of a leakage flux transformer as a distributed constant power supply circuit and forming a resonance circuit between the capacitive component of the secondary side circuit and the leakage inductance, as achieved in a small inverter circuit, in an inverter circuit for high-power discharge lamps while maintaining the advantage of the transformer of lesser heat generation.

It is a further object of the present invention to satisfy multiple conditions, such as the leakage inductance, the speed of the progressive wave (self-resonance frequency), the characteristic impedance and the thickness, at a time by connecting a plurality of transformers in parallel to be operable as a single high-power transformer, which widens the freedom of selection of the conditions.

It is a still further object of the present invention to acquire a sufficient leakage inductance and a practical self-resonance frequency even when using a core whose cross-sectional area is large and whose magnetic path is shorter as compared with the cross-sectional area, as in a case where the core of the transformer has a shape of the JIS standard or a modified shape of EE or EI type similar to the JIS standard shape.

It is a yet still further object of the present invention to reduce the leakage inductance while keeping the self-resonance frequency high by obliquely winding the secondary winding of the transformer even when the magnetic path of the core in use is longer as compared with the cross-sectional area of the core.

It is a yet further object of the present invention to satisfy multiple conditions, such as the leakage inductance, the speed of the progressive wave (self-resonance frequency), the characteristic impedance and the thickness, at a time by widening the freedom of selection of the conditions through a combination with a winding scheme which suppresses the leakage inductance and the distributed capacitance.

To achieve the objects, the present invention provides an inverter circuit for discharge lamps, which comprises a plurality of leakage flux step-up transformers each having a magnetically continuous central core, a primary winding, and a distributed-constant secondary winding, wherein a part of a resonance circuit is formed among a leakage inductance produced on the secondary winding side, a distributed capacitance of the secondary winding and a parasitic capacitance produced around a discharge lamp close to a proximity conductor, and as the resonance circuit resonates, the secondary winding has a close coupling portion in a vicinity of the primary winding which has a magnetic phase close to that of the primary winding and magnetically close couples with the primary winding and where a large portion of a magnetic flux produced under the primary winding penetrates, and a loose coupling portion distant from the primary winding which has a magnetic phase delayed from that of the primary winding and magnetically loose couples with the primary winding and where a large portion of the magnetic flux produced under the primary winding leaks, whereby a plurality of discharge lamps are lighted in parallel.

(Operation)

The operation of the present invention will be discussed below.

The present invention provides a high efficiency for the following reasons.

With regard to a discharge lamp, the following description of the present invention mainly discusses a cold-cathode fluorescent lamp, which is generalized as a discharge lamp since the discussion of the cold-cathode fluorescent lamp can be applied to the discharge lamp that has similar characteristics. The "capacitive component" of the secondary side circuit of a step-up transformer in an inverter circuit for discharge lamps according to the present invention is the sum of a parasitic capacitance $C_w$ produced on the secondary winding, a parasitic capacitance $C_s$ produced around the wiring, the shunt circuit and the discharge lamp, and an auxiliary capacitance $C_a$ added in an auxiliary manner as shown in FIG. 11. The conductor that is located close to the discharge lamp is essential for producing the parasitic capacitance of the discharge lamp and the distance between the discharge lamp and the proximity conductor should be defined accurately.

As the capacitance on the secondary side and the leakage inductance $L_s$ (JIS) of the step-up transformer resonate, a resonance circuit including a three-terminal equivalent circuit of the transformer is formed as shown in FIG. 12, and the inverter circuit is operated at a frequency close to the resonance frequency, whereby an area where the exciting current as seen from the primary side of the transformer is reduced is produced as shown in FIG. 13. This area is used. Reduction in exciting current means an improvement of the power factor. As a consequence, the exciting current in the primary winding of the transformer is reduced and the copper loss is reduced, thereby improving the conversion efficiency of the inverter circuit.

When the self-resonance frequency of the secondary winding of the transformer approaches one to three times or less the operational frequency of the inverter circuit under such a condition, the delay of the distributed constant noticeably appears on the secondary winding, causing the so-called phase-shift (phase modification) in which the current phase of the portion of the secondary winding which is far from the primary winding is delayed from the current phase of the portion of the secondary winding which is close to the primary winding.

When such a phase-shift (phase modification) phenomenon occurs, the flux leakage from the core under the secondary winding of the transformer is dispersed over the entire core on the secondary winding side, thus reducing the core loss. The flux leakage in the conventional leakage flux transformer leaks a lot at the boundary between the primary winding and the secondary winding, so that the core loss at the portion where the magnetic flux leaks becomes larger, resulting in concentration of generated heat.

With the secondary winding with a distributed constant being taken as a transmission path, when the characteristic impedance of the transmission path is not matched with the terminal load, an echo occurs as is known by the echo of a delay line, generating a standing wave. As the standing wave stands in the way of averaging the core loss, it should be reduced as much as possible. In this case, the echo wave disappears by making the characteristic impedance of the distributed-constant secondary winding with the impedance of the load equal to each other. This causes uniform phase-shift (phase modification) so that the ideal close coupling portion/loose coupling portion structure can be obtained.

By forming a close portion and a far end portion in the relationship between the secondary winding and the primary winding of the transformer, the progressive wave generated travels from the close portion to the far end portion. It is therefore advantageous to prevent the generation of the standing wave as much as possible by reducing the component of the magnetic flux generated from the primary winding which travels to the close portion from the far end portion.

To assist the close coupling in the structure of the present invention, first, it is desirable that the core should take an I/O type shape and the center core should be a single rod-like core.

When the core is separated into an EE type for the sake of production convenience and is later connected in an assembling step, it is also desirable that the center core should be connected as seamlessly as possible and should be magnetically continuous.

Further, even when the core has a shape which is close to the JIS standard shape and whose magnetic path is shorter than the core's cross-sectional area, and even if the coupling coefficient is high, a large leakage inductance can be achieved by winding multiple very thin wires as compared with those in the conventional inverter circuit.

The expression "magnetically continuous" means that there is no large gap intentionally provided. In the structure where a center gap is intentionally provided in the transformer using a core with the EE shape to provide segmentation in the core under the secondary winding, the structure of the close coupling portion is obstructed which is disadvantageous.

While the provision of the center gap is normally considered as increasing the leakage flux to increase the leakage inductance, this line of thought is wrong as far as implementation of the present invention is concerned. To work out the present invention, it is desirable that the center gap should be made as thin as possible and should be limited to a degree so as to stabilize the inductance of the core material. The point of adjustment on the secondary winding is such that with the gap being constant, the primary winding and the secondary winding are implemented, then the leakage inductance $L_s$ (JIS) of the secondary winding is measured with the primary winding short-circuited, it is determined whether the leakage inductance $L_s$ (JIS) is large or not, and the number of turns of the secondary winding is changed according to the result of the decision to thereby adjust the leakage inductance.

Although those operations have already been achieved easily in a small-core transformer as shown in FIG. 14, it has been considered difficult to achieve those operations with a single large transformer for the reasons given so far.

One way to overcome the problem is to connect a plurality of small or middle-sized transformers which can achieve the operations in parallel, so that the transformers would behave as if they were a single large transformer.

FIG. 15 shows the secondary windings of transformers connected in parallel; T1, T2 and T3 in the diagram are transformers illustrated as inverted-L type equivalent circuits which are applied when the transformers are driven with a low impedance as done when they are switching-driven, and $L_{s1}$, $L_{s2}$ and $L_{s3}$ are leakage inductances (JIS) on the secondary winding side.

The leakage inductances (JIS) of the individual transformers are combined in parallel and the combined leakage inductance is the leakage inductance of each transformer divided by the number of the transformers.

In such a case, if the leakage inductances of the individual transformers are approximately equal to one another, the current that flows across the load is dispersed in the individual transformers, so that the load is dispersed and the generated heat is dispersed over the individual transformers. Further, the heat radiation area becomes larger.

Because the self-resonance frequency of the secondary winding of the transformer does not change even when plural windings are connected in parallel, the speed of the progressive wave that travels on the secondary winding stays the same as the value each transformer has. The step-up ratio also does not change. The characteristic impedance of the distributed-constant secondary winding becomes the characteristic impedance divided by the number of the transformers.

All in all, when the transformers are connected in parallel, power to be converted is the sum of the performances of the individual transformers. Accordingly, a high-power transformer whose realization with a single transformer has been difficult can be realized easily by connecting plural transformers in parallel.

When the power of the transformers becomes insufficient in a high-power inverter circuit, merely making parallel connection of small or middle-sized transformers whose quantity matches with the insufficient amount of power can allow the transformers to behave as a transformer equivalent to a transformer with as high power as demanded.

The impedance of the cold-cathode fluorescent lamps that are combined by the parallel lighting circuit is equal to the result of adding the impedances in parallel. The parallel lighting circuit causes the parasitic capacitance produced around the cold-cathode fluorescent lamp to be the sum of all the parasitic capacitances.

While the parasitic capacitance becomes an added-up value in proportion to the number of the cold-cathode fluorescent lamps, the leakage inductance and the characteristic impedance of the combined transformers becomes small inversely proportional to the number of the transformers. This means that the resonance frequency which is defined by the capacitive component of the secondary side circuit and the leakage inductance of the step-up transformer does not vary significantly, and also means that the relationship between the combined impedance of the cold-cathode fluorescent lamps and the characteristic impedance of the secondary winding of the transformer does not vary significantly.

In other words, the resonance circuit including a cold-cathode fluorescent lamp load and the capacitive component of the secondary side circuit which is constructed between the leakage inductance (JIS) has a very simple structure as shown in FIG. 16. In view of the above, an inverter circuit for a high-power surface light source can be designed compact and simple while maintaining the operation and advantages of the invention described in U.S. Pat. No. 5,495,405 which has already been put to practical use in notebook type personal computers.

The present invention can realize a transformer equivalent to a single high-power transformer and, at the same time, achieve high power for an inverter circuit without sacrificing the operation and advantages of the invention described in U.S. Pat. No. 5,495,405 by combining a plurality of transformers and connecting the secondary windings in parallel.

It is also possible to make the inverter circuit thin and to achieve cost reduction thereof by adequately setting the number of control circuits to one or two.

Further, it is unnecessary to make the number of transformers and the number of discharge lamps proportional to an integer multiple and it is possible to realize an inverter circuit with the required power by making parallel connection of small or middle-sized transformers whose quantity corresponds to the total power of the discharge lamps.

Furthermore, with the present invention combined with the invention in U.S. Ser. No. 10/773,230, the number of the discharge lamps and the number of the transformers should simply have a proportional relationship, overcoming the conventional problem that the number of the discharge lamps assigned per a single transformer is limited. That is, the quantity relationship may involve quantities undividable into an integer such as, for example, twelve discharge lamps for five transformers. This increases the degree of freedom in selecting transformers. Accordingly, unlike the designing of the conventional inverter circuit which needs development of new transformers optimized for the type of the surface light source and each property of the discharge lamps to be used, a new design is hardly needed, and of the bobbins of transformers conventionally often used in notebook type personal computers or liquid crystal monitors, those bobbins which have a relatively small number of sections are used directly to achieve an improvement of winding multiple wires thinner than those used in the prior art. Therefore, mere readjustment of the winding parameters can permit a substantial quantity of conventional bobbins to be used in the transformers of the present invention. In this case, it is needless to say that the resultant transformers which appear hardly different from the original transformers have quite different properties.

As a high-power inverter circuit can be realized by making good use of the conventional resources, the development cost becomes hardly necessary or becomes small in most cases.

In addition, the wiring from the inverter circuit to the discharge lamp is not restricted, eliminating the layout restriction on the inverter circuit, so that the inverter circuit can be laid out at any desired position, such as at the back or at the edge of the surface light source.

DETAILED DESCRIPTION OF THE PREFERRED EMBODIMENT

Figure 1:
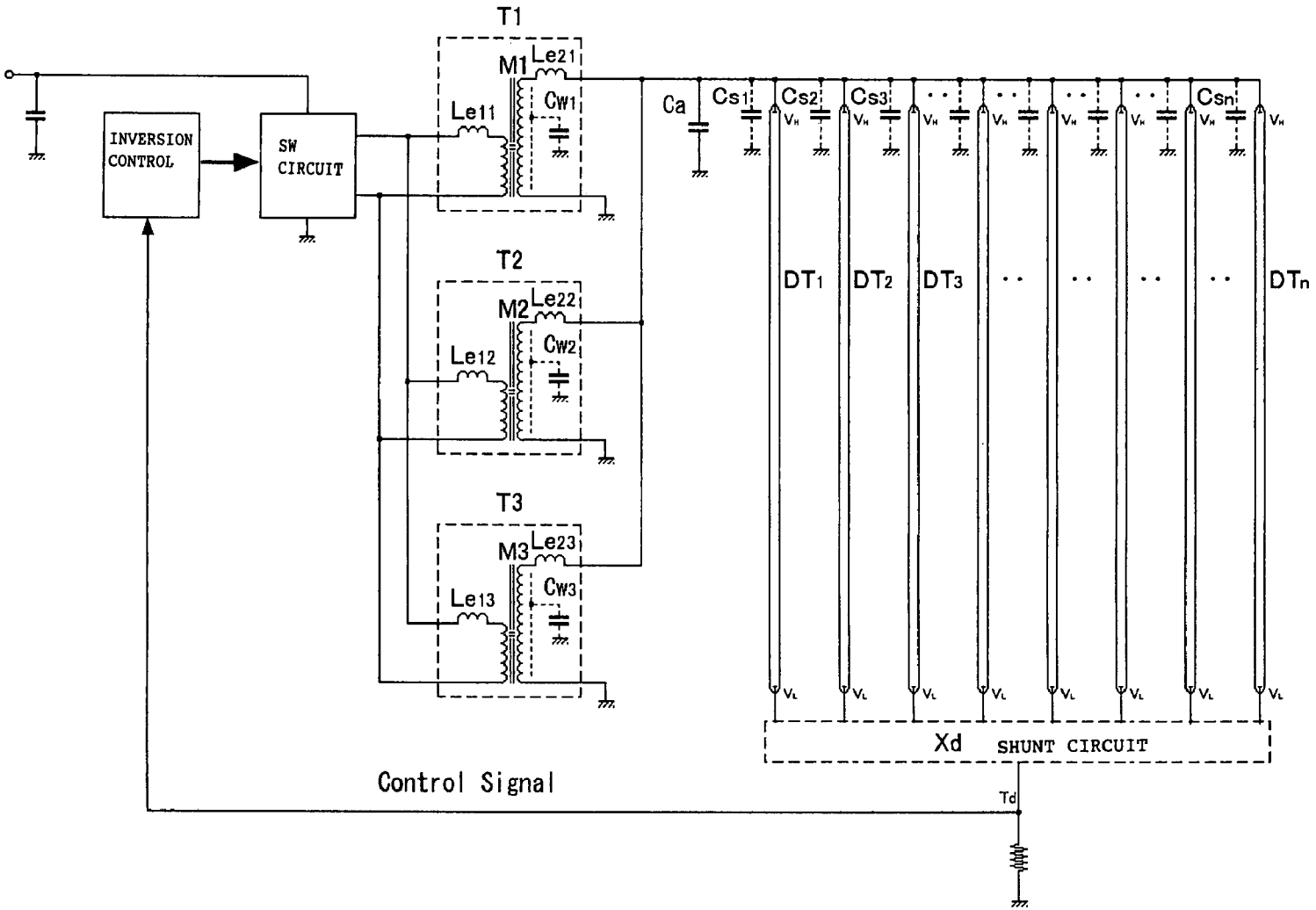
FIG. 1 is an equivalent circuit diagram illustrating one embodiment of the present invention.
Figure 2:
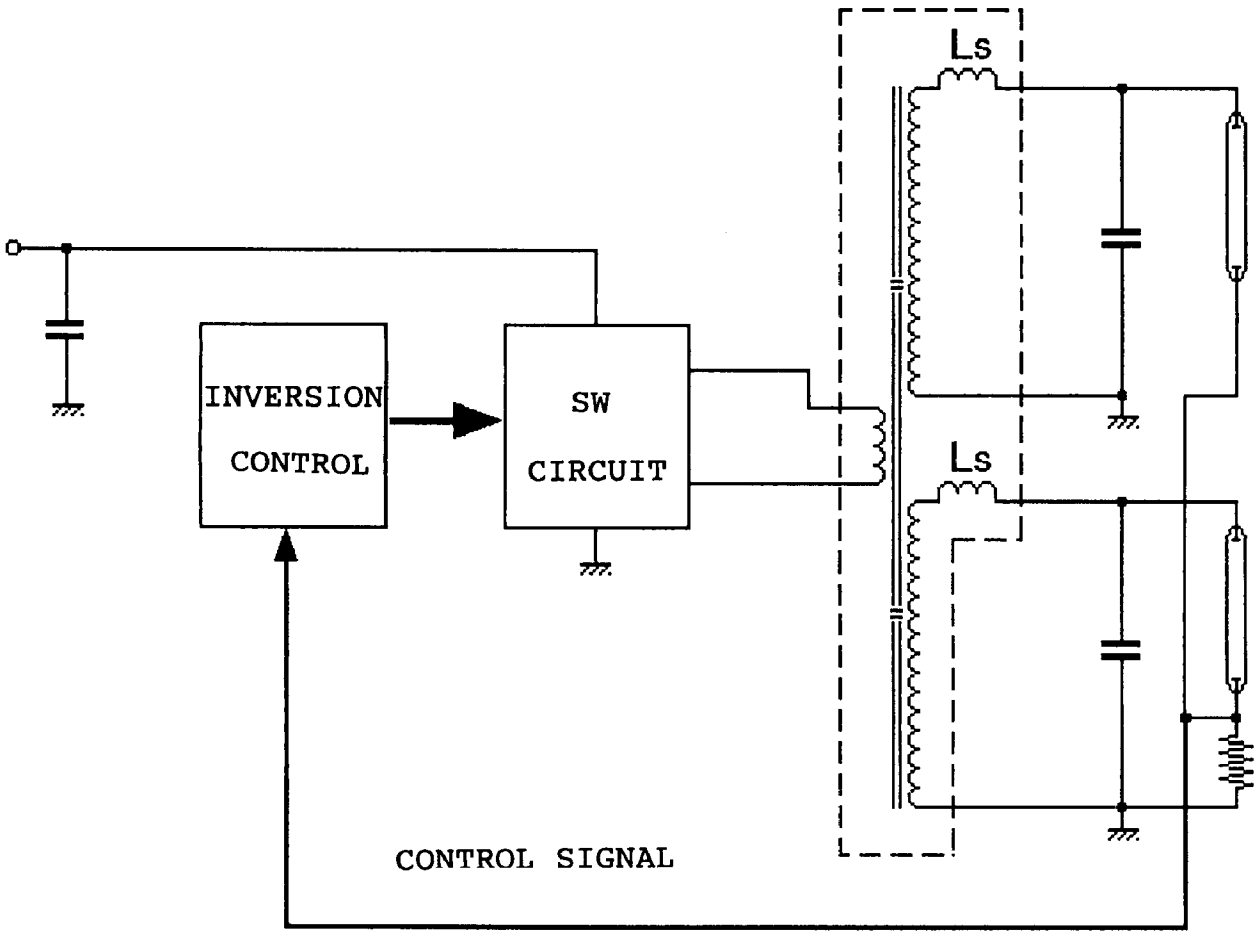
FIG. 2 is a structural diagram of an example of a conventional inverter circuit for a multi-lamp surface light source, showing one small leakage flux transformer laid out per two cold-cathode fluorescent lamps.
Figure 3:
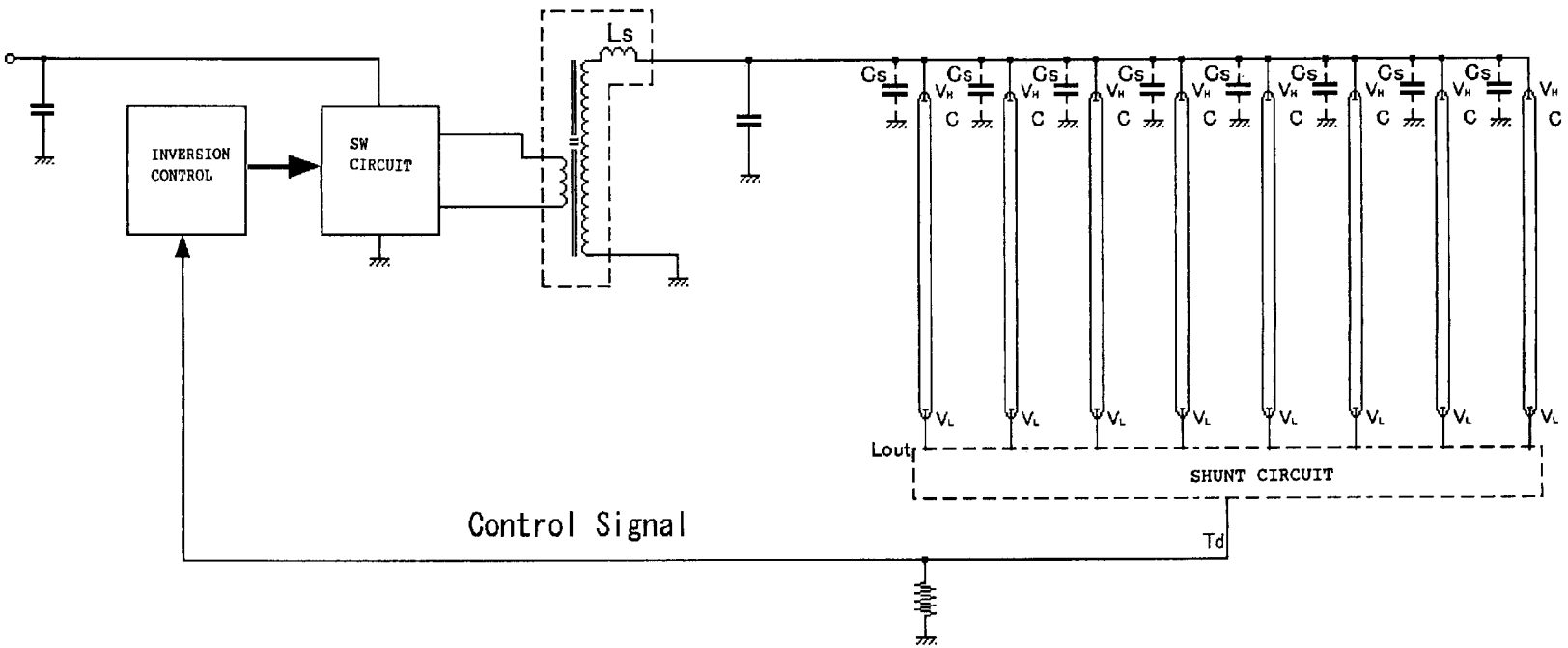
FIG. 3 is an equivalent circuit diagram showing one example of parallel-driving multiple cold-cathode fluorescent lamps.
Figure 4:
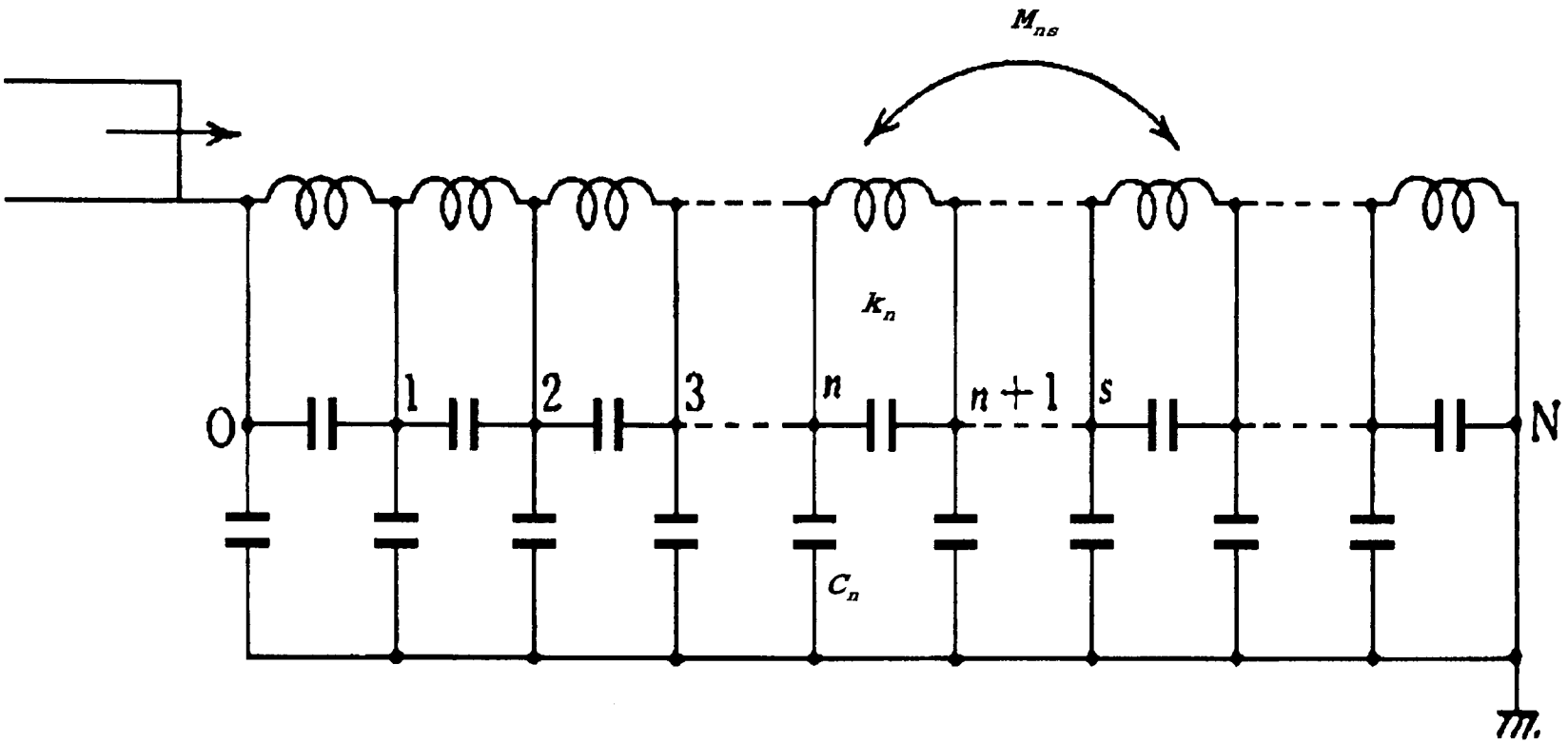
FIG. 4 is an equivalent circuit diagram for explaining one example of the distributed capacitance of the winding of a transformer.
Figure 5:
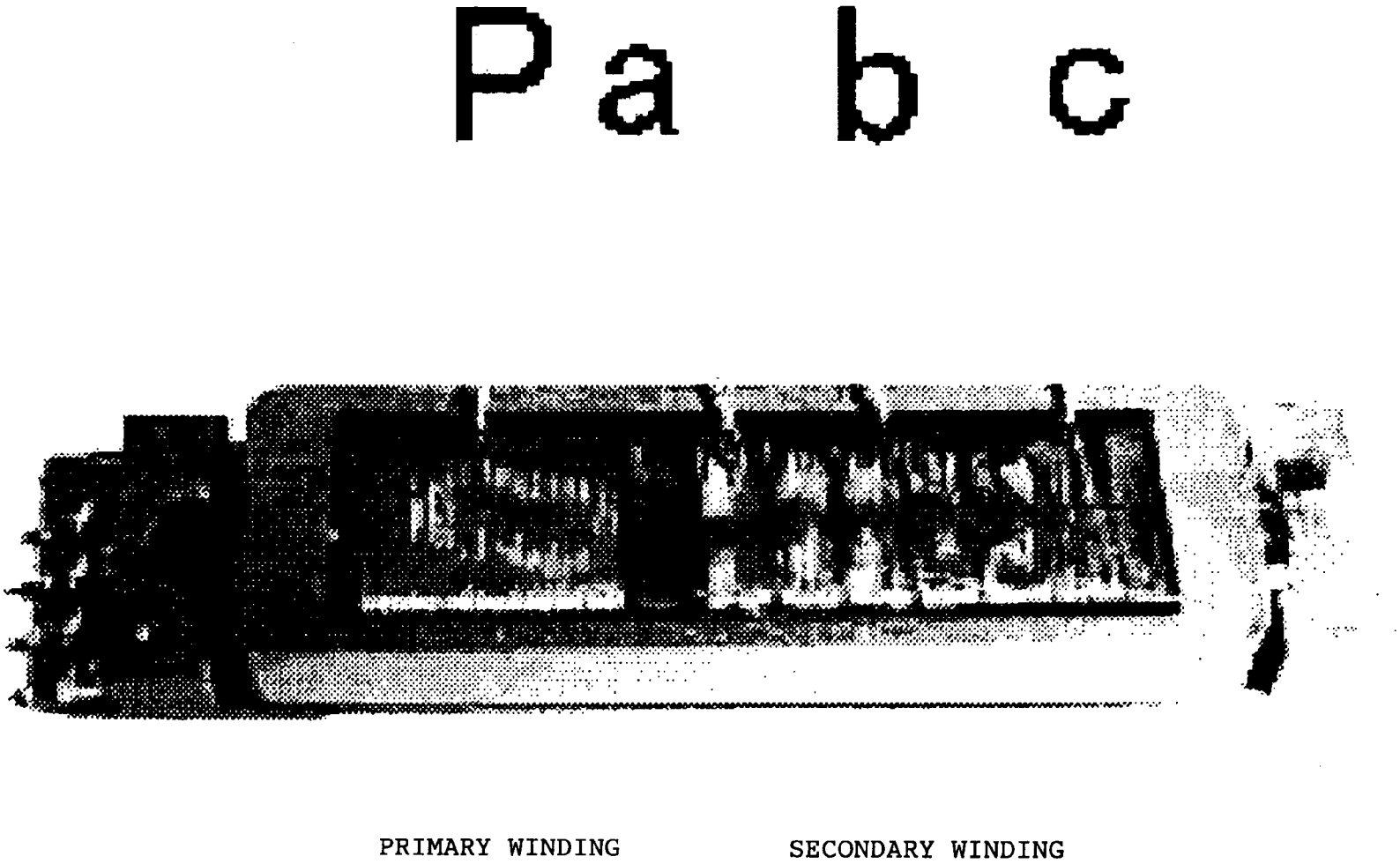
FIG. 5 is a perspective structural sketch illustrating one example of a signal detecting position for showing the so-called phase-shift or phase modification phenomenon in which signal delay occurs in a step-up transformer for an actual cold-cathode fluorescent lamp toward a portion of the secondary winding which is far from the primary winding.
Figure 6:
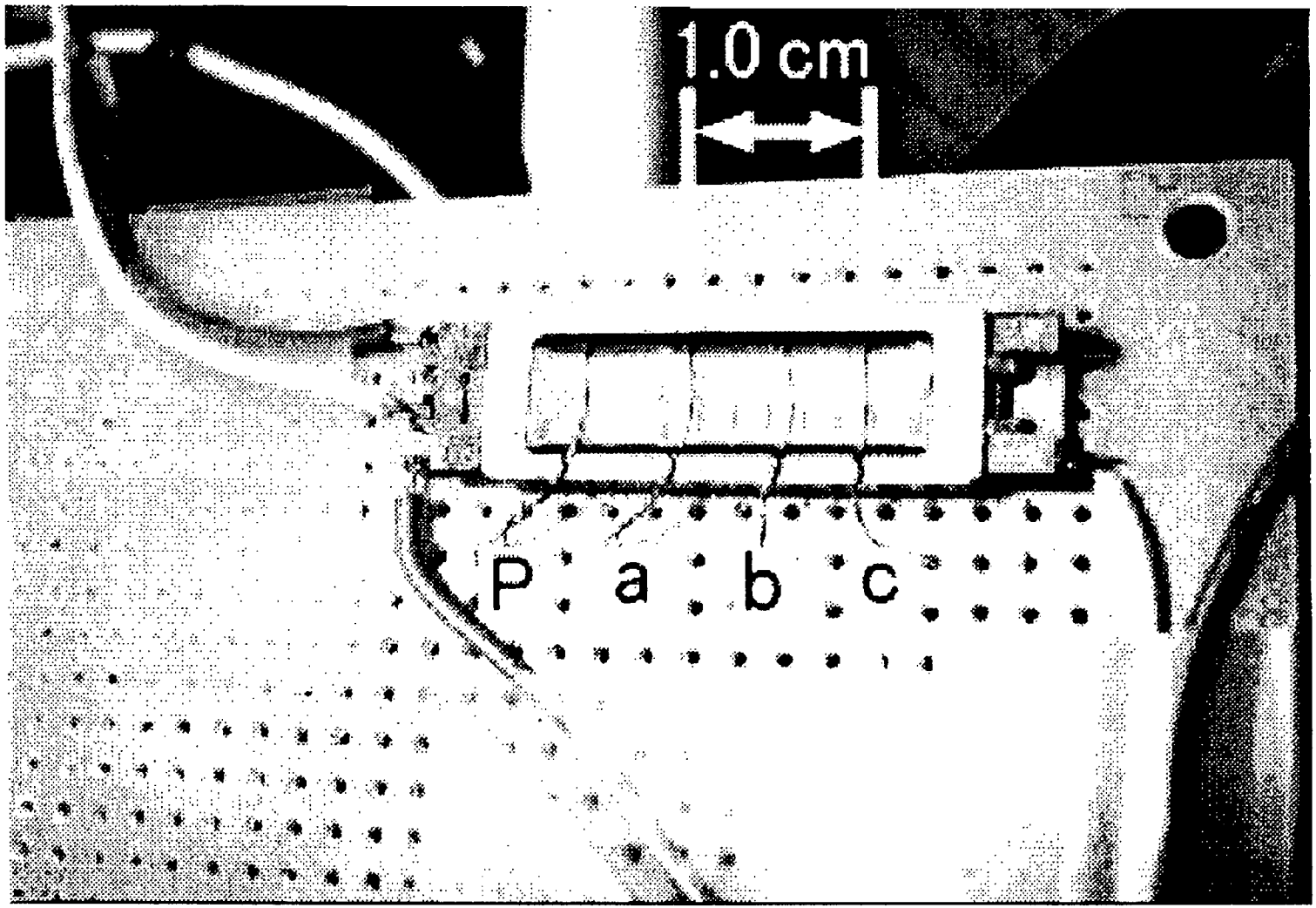
FIG. 6 is a plan structural sketch illustrating one example of a signal detecting position for showing the so-called phase-shift or phase modification phenomenon in which signal delay occurs in a step-up transformer for an actual cold-cathode fluorescent lamp toward a portion of the secondary winding which is far from the primary winding.
Figure 7:
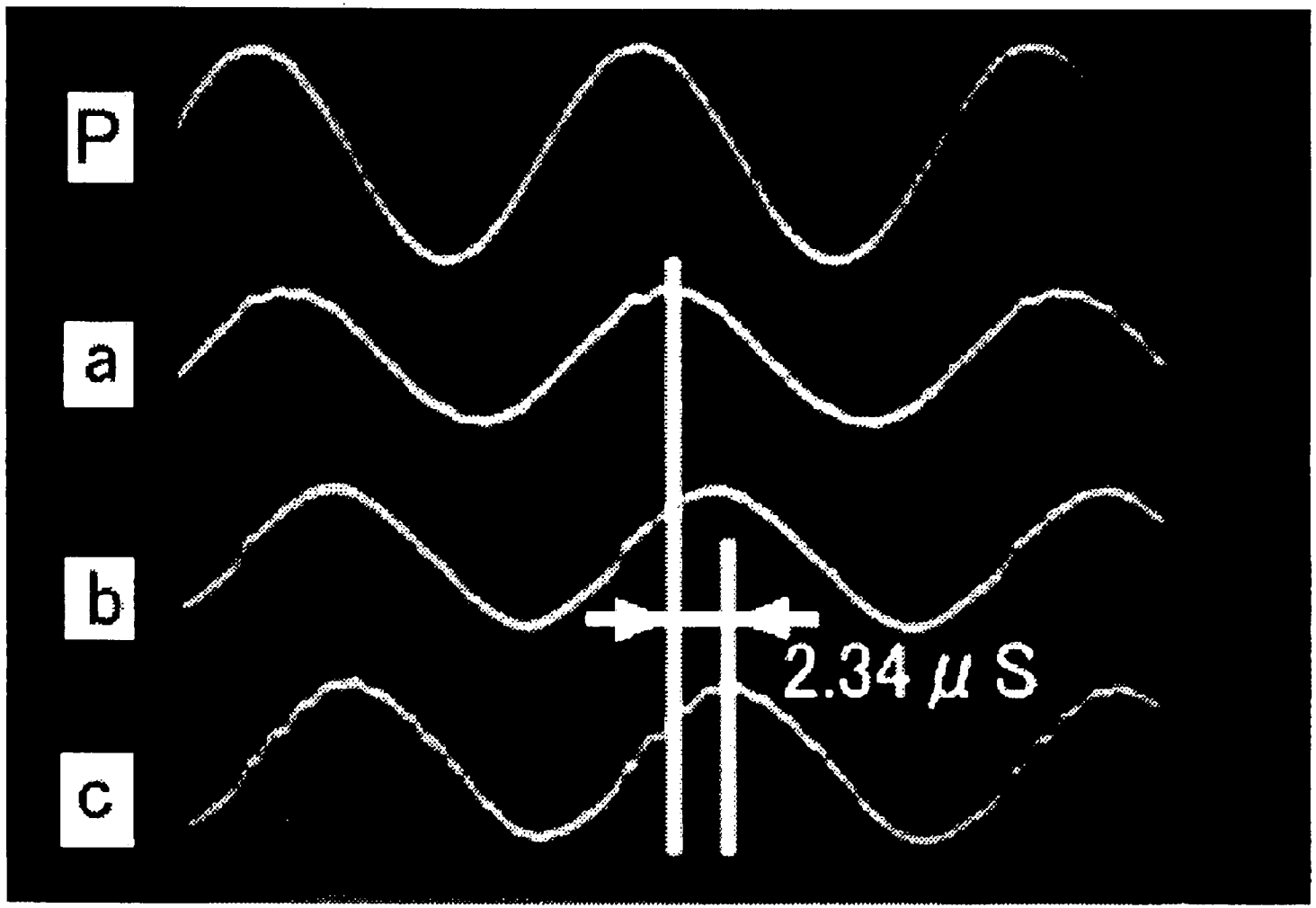
FIG. 7 is a waveform diagram illustrating one example of the so-called phase-shift or phase modification phenomenon in which signal delay occurs in a step-up transformer for an actual cold-cathode fluorescent lamp toward a portion of the secondary winding which is far from the primary winding.
Figure 8:
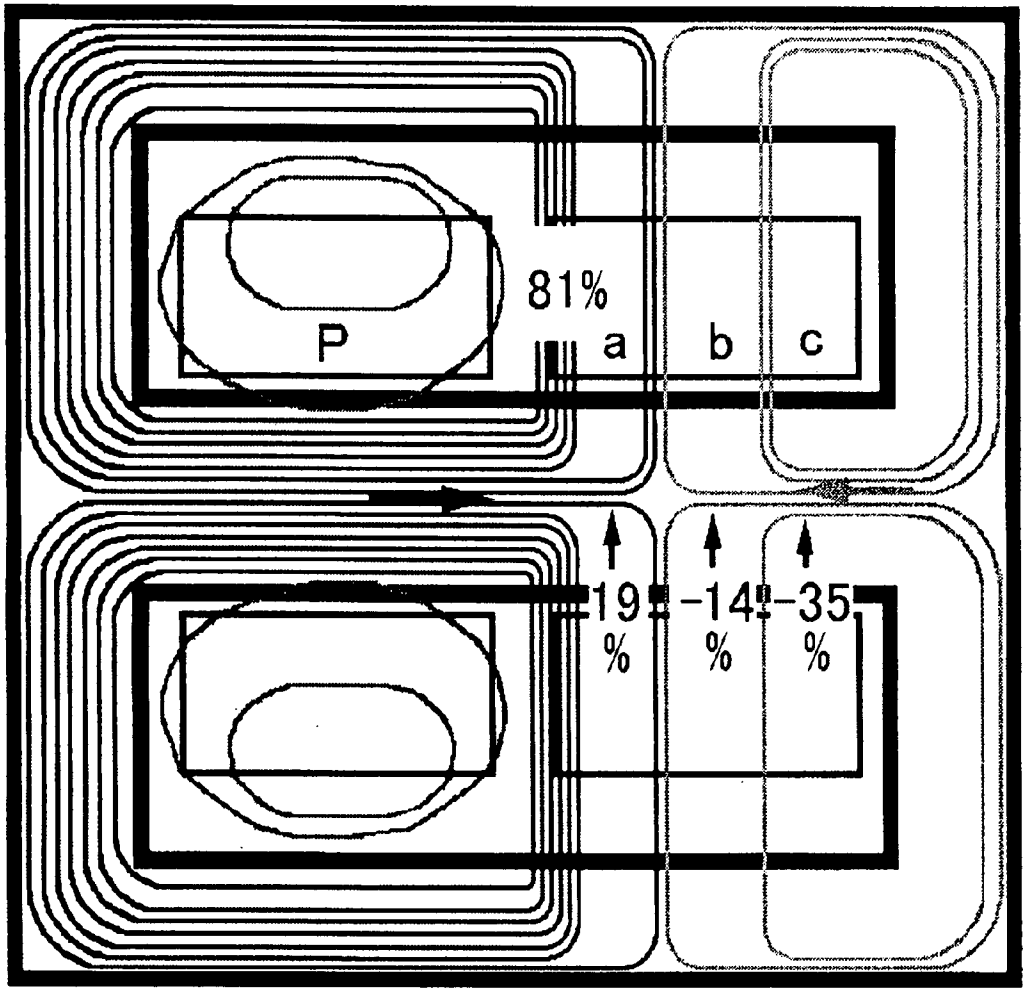
FIG. 8 is an exemplary diagram of the magnetic flux of a phase-modifying transformer, showing one example where a close coupling portion is formed as a major portion of the magnetic flux generated on the primary winding penetrate the secondary winding as a result of the phase modification phenomenon.
Figure 9:
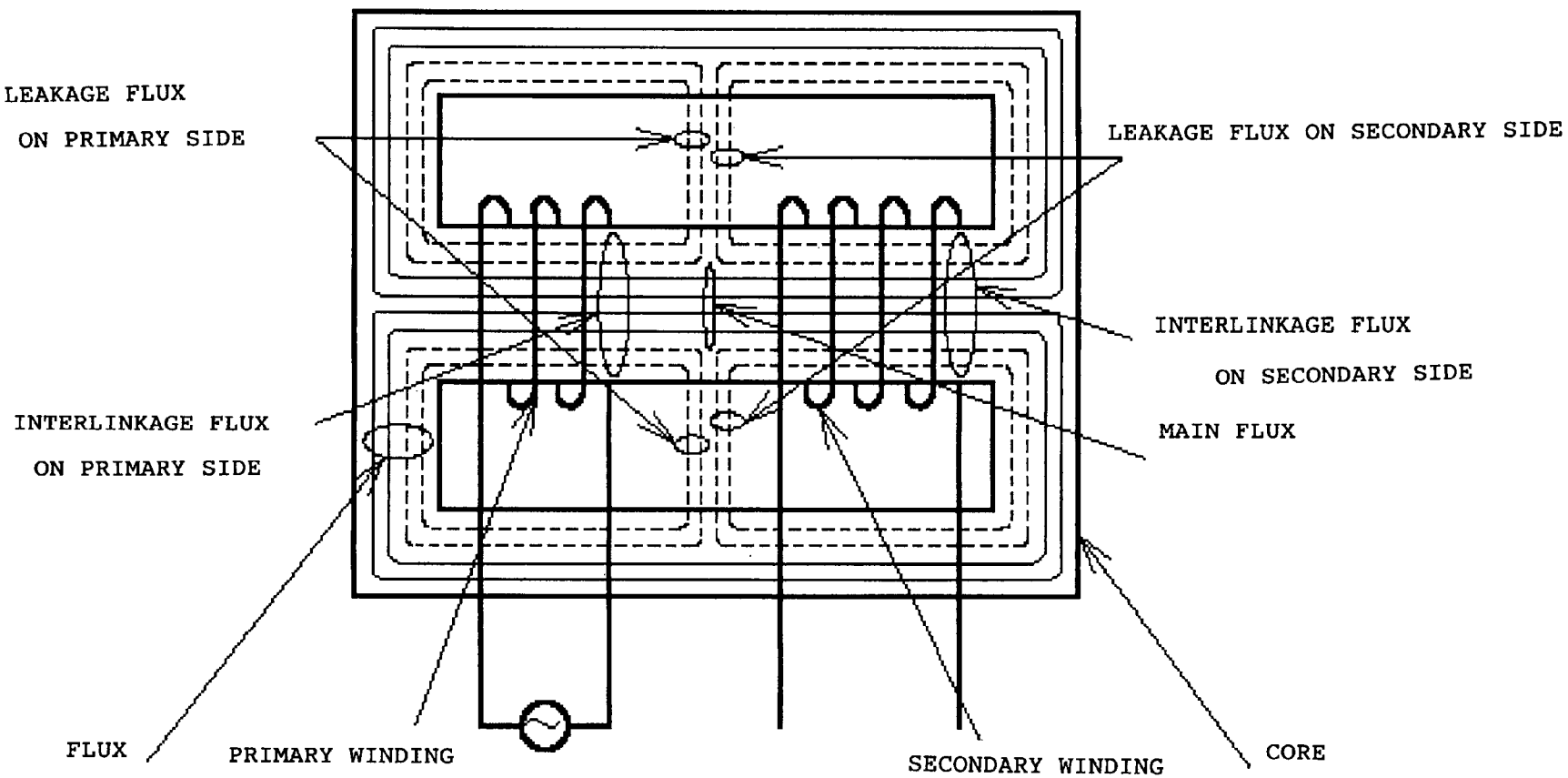
FIG. 9 is an exemplary diagram of the magnetic flux showing the main magnetic flux and the leakage flux in a conventional transformer.
Figure 10:
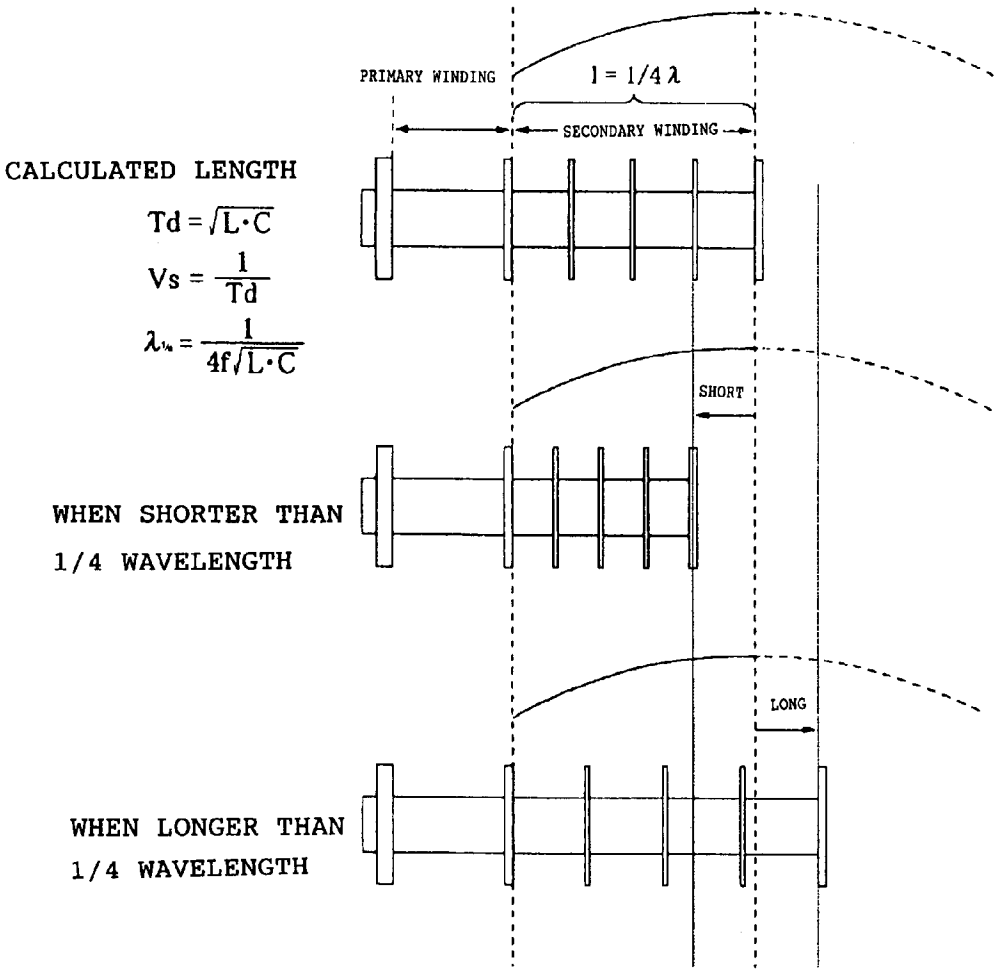
FIG. 10 is an explanatory diagram showing one example of a resonance phenomenon which occurs when the ¼ wavelength of a progressive wave generated on the secondary winding of the transformer in an inverter circuit coincides with the physical length of the bobbin of the secondary winding.
Figure 11:
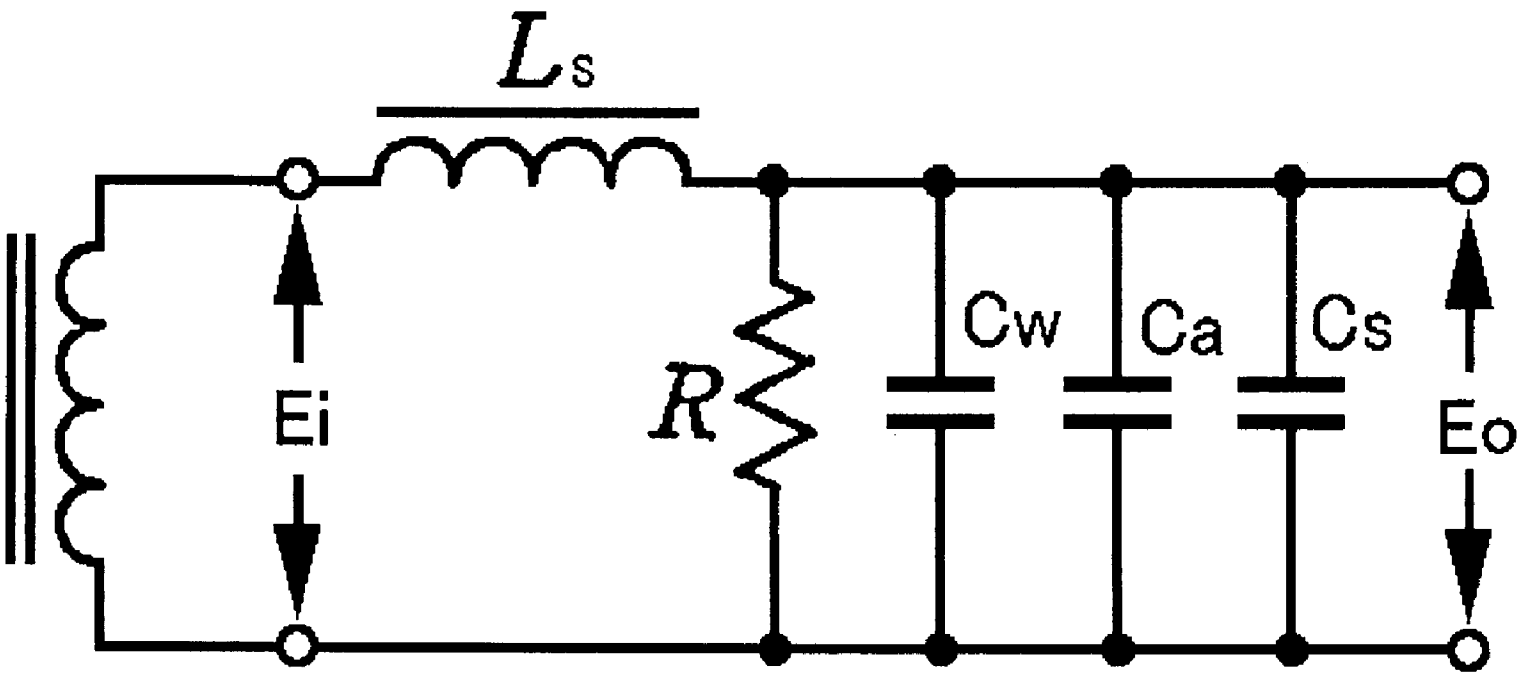
FIG. 11 is an equivalent circuit diagram showing one example for explaining that the capacitive component of the secondary side circuit of a step-up transformer in an inverter circuit for discharge lamps according to the present invention is the sum of the parasitic capacitance $C_w$ produced on the secondary winding, the parasitic capacitance $C_s$ produced around the wiring, the shunt circuit and the discharge lamp, and the auxiliary capacitance $C_a$ added in an auxiliary manner, and a resonance circuit is formed between a discharge load R connected in parallel to those capacitive components and the leakage inductance $L_s$.
Figure 12:
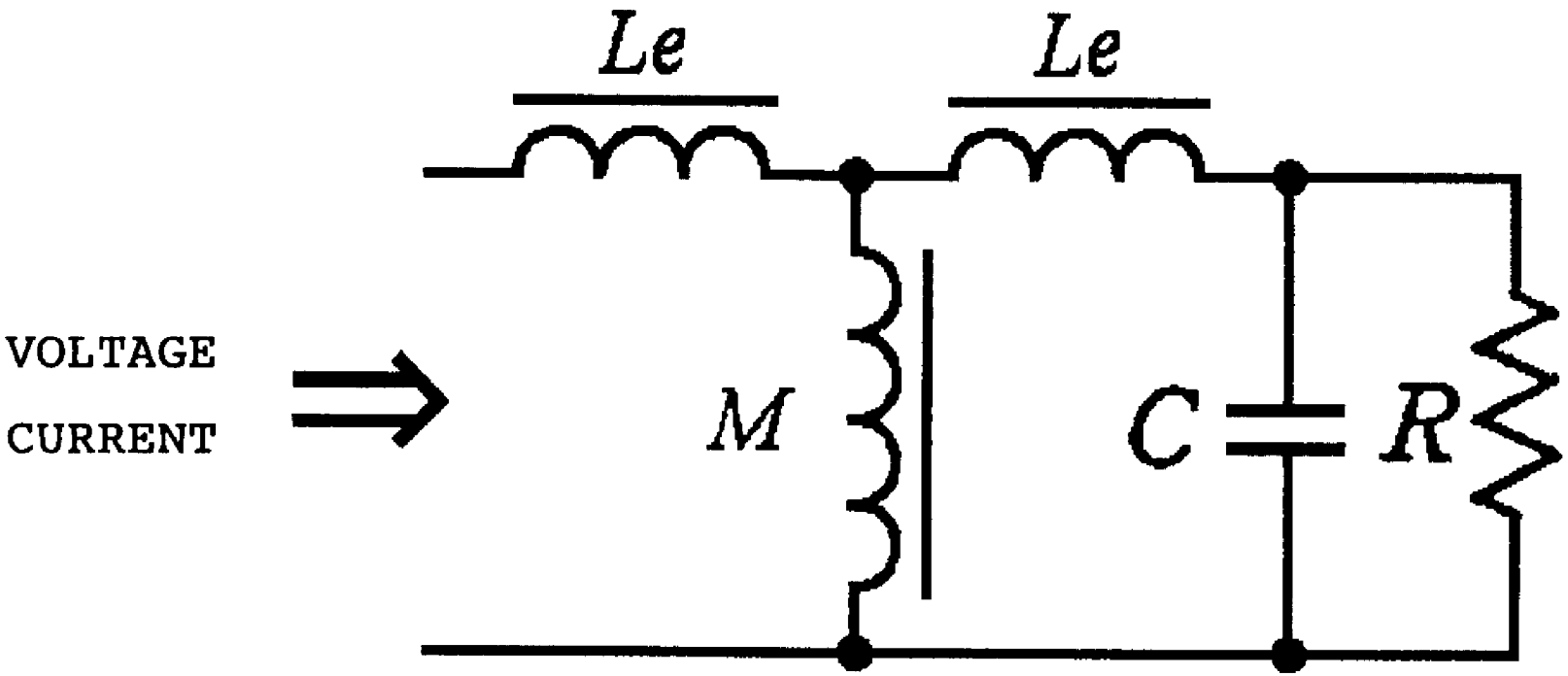
FIG. 12 is an equivalent circuit diagram for explaining that the conversion efficiency of an inverter circuit is improved as a resonance circuit including a three-terminal equivalent circuit of a transformer is formed and the exciting current of the primary winding of the transformer is reduced, which reduces the copper loss.
Figure 13:
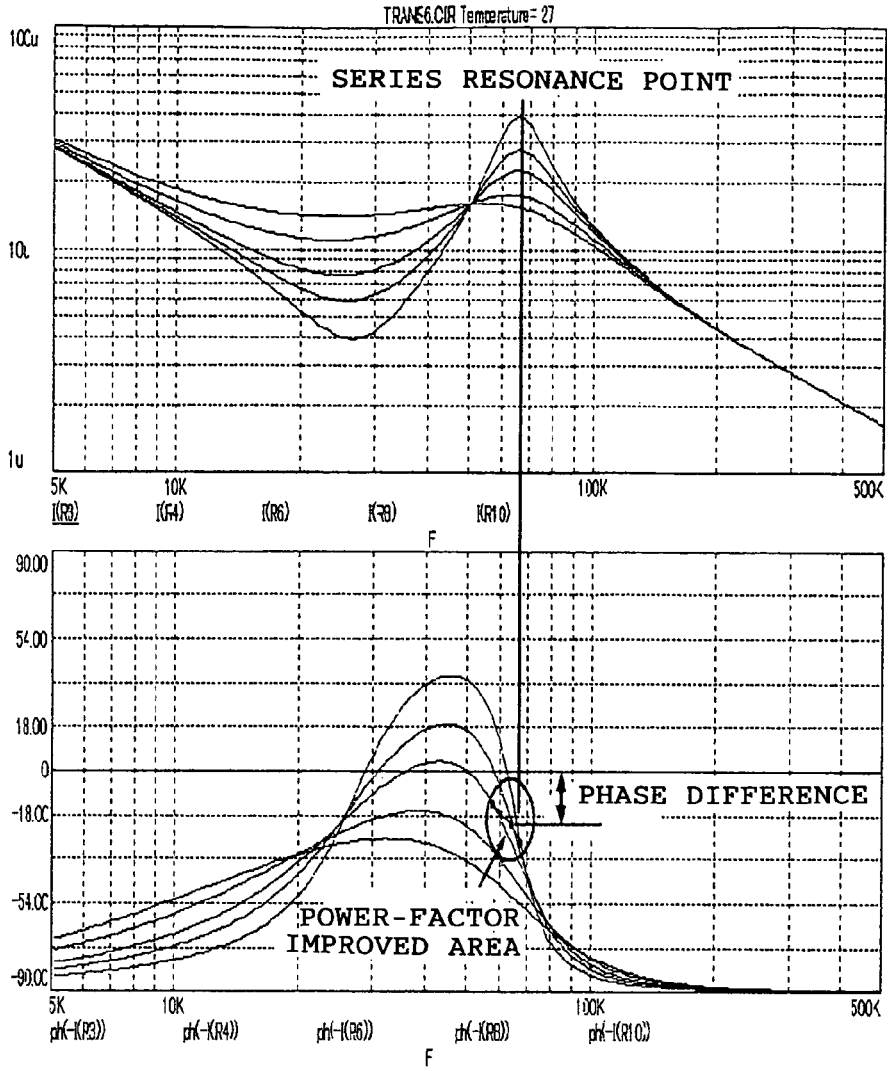
FIG. 13 shows graphs for explaining that the power factor is improved by reduction in exciting current resulting from changing the resistance R, so that when the inverter circuit is operated at a frequency close to the resonance frequency, an area where the exciting current as seen from the primary side of the transformer becomes smaller is produced, the upper graph showing the frequency on the horizontal axis and the admittance on the vertical axis while the lower one shows the frequency on the horizontal axis and the phase difference between voltage and current on the vertical axis.
Figure 14:
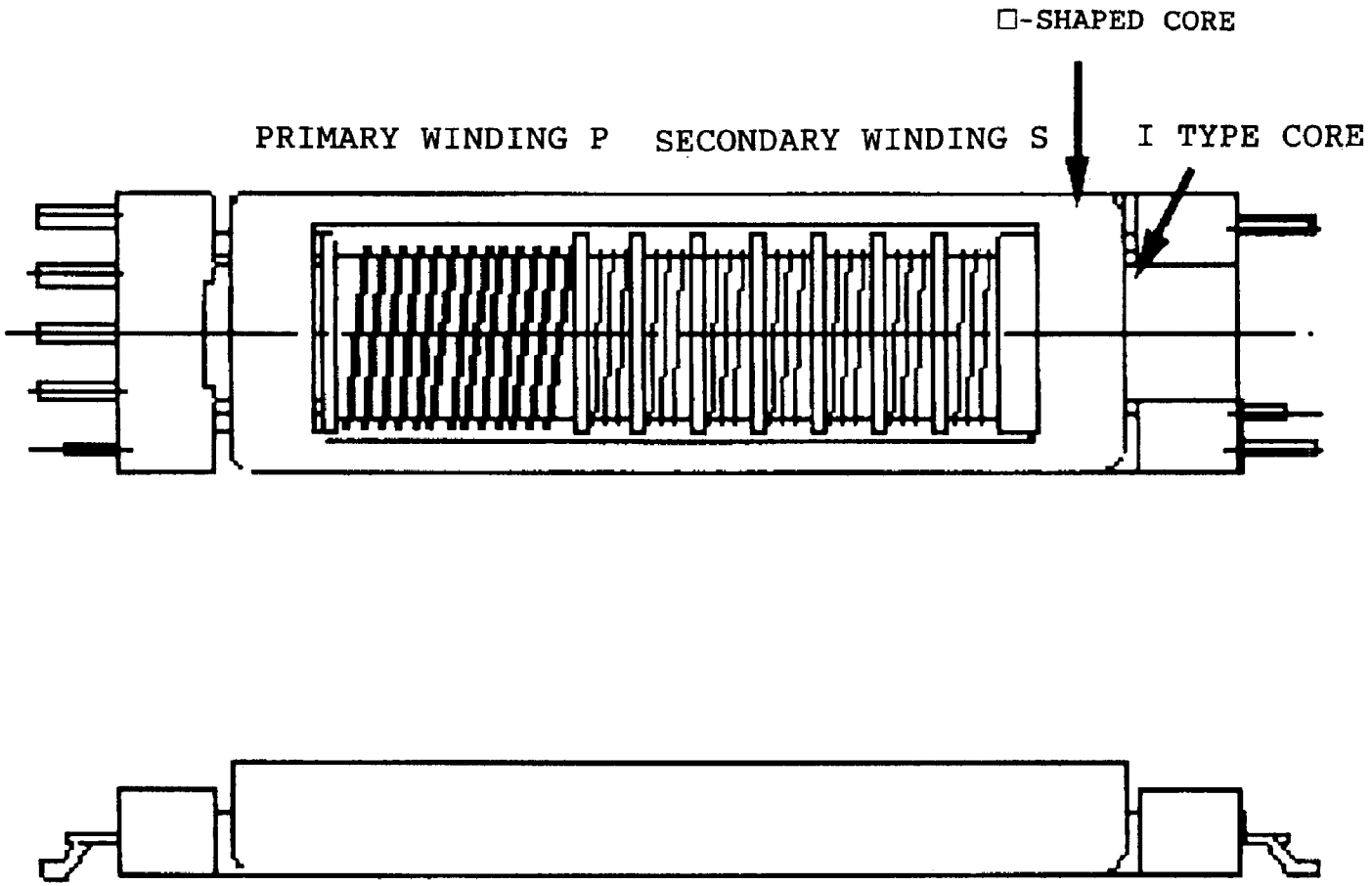
FIG. 14 is a structural diagram showing one example of the structure of a small-core transformer using an IO type core.
Figure 15:
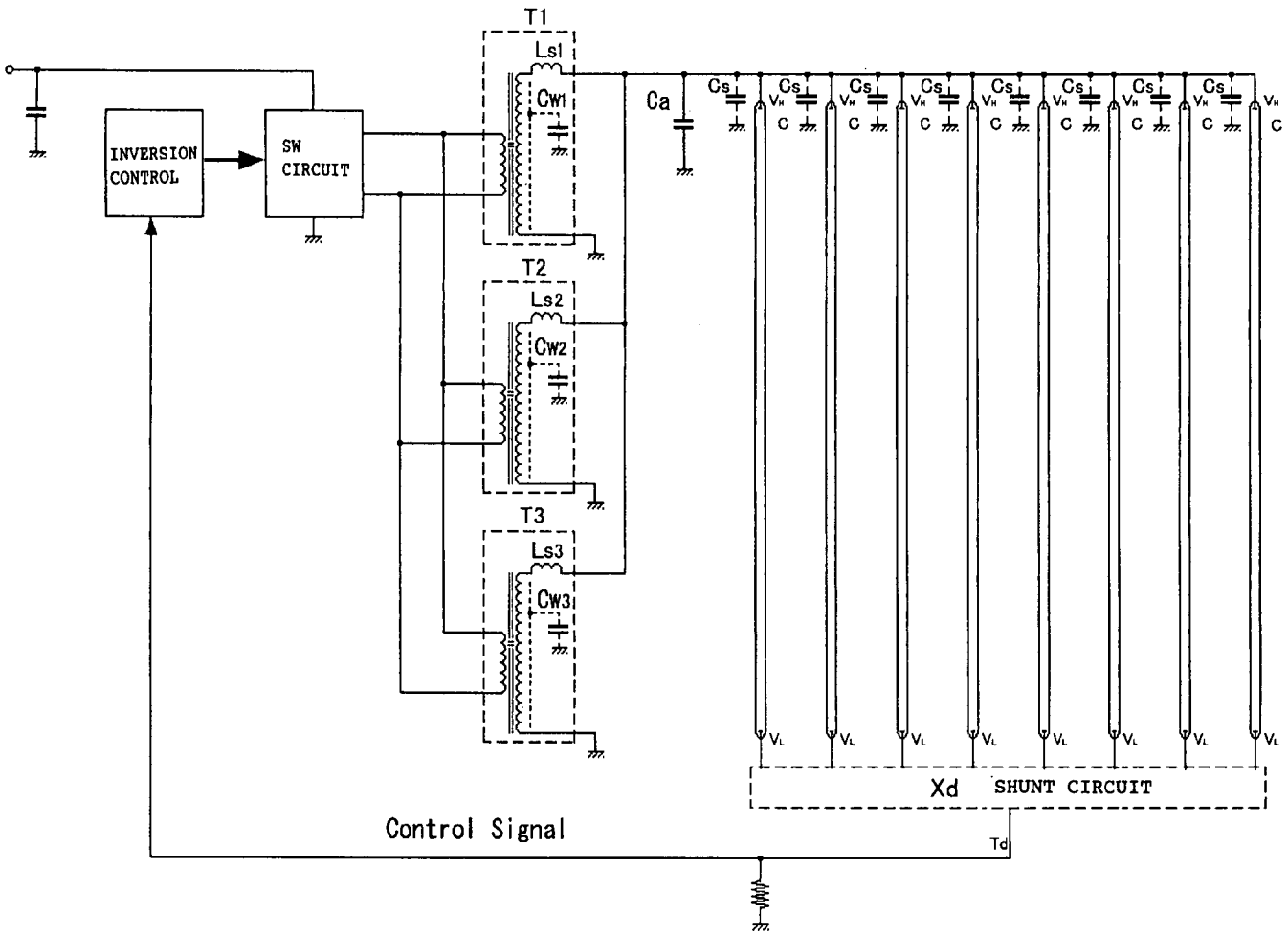
FIG. 15 is an equivalent circuit diagram of an inverter circuit showing one example of the structure where the secondary windings of transformers are connected in parallel.
Figure 16:
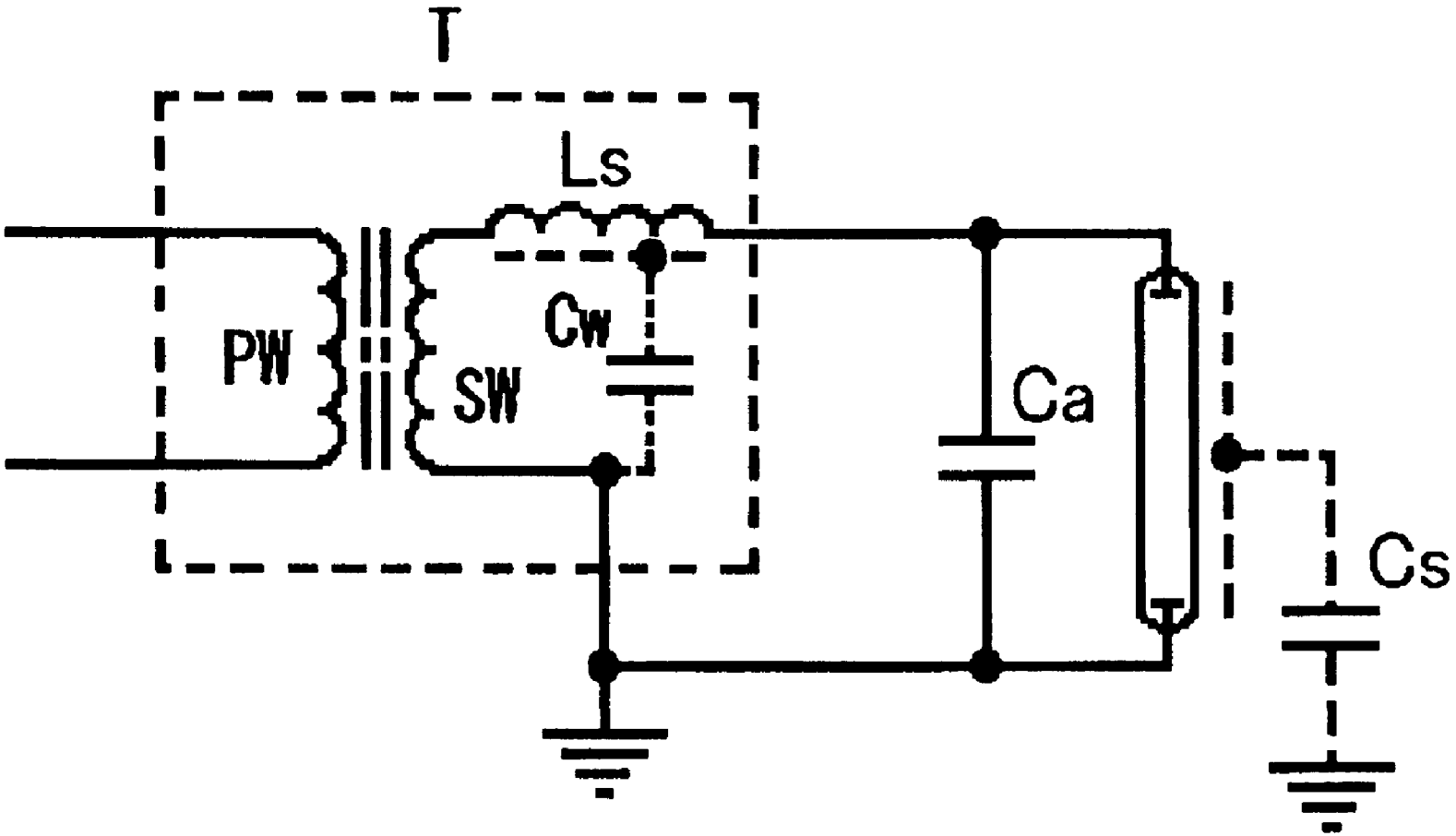
FIG. 16 is a diagram showing one example of a resonance circuit including a cold-cathode fluorescent lamp load formed between the leakage inductance (JIS) and the capacitive component of the secondary side circuit.

A preferred embodiment of the present invention will be described below with reference to the accompanying drawings. FIG. 1 illustrates one embodiment of the present invention with a transformer shown in an equivalent circuit. As the transformer is not an ideal one, it has a leakage flux which forms an inductance or leakage inductance.

The leakage inductance is equivalent to choke coils inserted at the output of the transformer which are indicated by $L_{e11}$ to $L_{e13}$ and $L_{e21}$ to $L_{e23}$. The self-inductances $L_{01}$ to $L_{03}$ of the secondary windings are the series-combined values of mutual inductances $M_1$ to $M_3$ and the leakage inductances $L_{e21}$ to $L_{e23}$, though not described.

$C_{w1}$ to $C_{w3}$ are the distributed capacitances of the secondary windings, which, together with the self-inductances of the secondary windings, form the self-resonance frequency $f_p$. $X_d$ is a shunt circuit which lights cold-cathode fluorescent lamps in parallel and is adequately inserted according to the characteristics of the cold-cathode fluorescent lamps. $C_{s1}$ to $C_{sn}$ are parasitic capacitances produced around the cold-cathode fluorescent lamps, and $C_a$ is an auxiliary capacitance for adjusting the resonance frequency.

In the embodiment, the secondary windings of three transformers are connected in parallel. As a result, the leakage inductances $L_{e1}$, $L_{e2}$ become ⅓ of the leakage inductances $L_{e11}$ to $L_{e13}$ and the leakage inductances $L_{e21}$ to $L_{e23}$, respectively, $C_{w1}$ to $C_{w3}$ are combined to be $C_w=3C_{w1}$. As the self-inductance $L_o$ of the secondary winding also becomes ⅓, the self-resonance frequency $f_p$ formed by $C_w$ and $L_o$ does not change. $C_{s1}$ to $C_{sn}$ of the cold-cathode fluorescent lamps are all added up to be $C_s$. The impedance Z is inversely proportional to the number of the cold-cathode fluorescent lamps.

That is, when the surface light source has high power and multiple cold-cathode fluorescent lamps need to be lighted in parallel, the relationship between the parameter of the secondary winding and the impedance of the discharge lamp or the parasitic capacitance is changed proportional or inversely proportional, without being ruined, by increasing the number of transformers required. A surface light source with any larger power can be coped with by expanding this principle.

As the feature of the present invention lies in that the secondary windings are connected in parallel, the connection of the primary winding side is not limited to that of the embodiment, and the primary windings may be connected to different drive circuits or connected in parallel or in series.

As the characteristic impedances of the secondary windings are combined in parallel by the number of transformers even when such connection is made, the characteristic impedance can be reduced without affecting the speed of the progressive wave on the secondary winding. That is, it is possible to create the characteristic impedance that is matched with the impedance of the discharge lamp as much as possible without making the parallel connection of the transformers a cause for generating a standing wave.

When a core with the JIS standard shape called an EI type or EE type (the magnetic path being shorter than the cross-sectional area) is used, the coupling coefficient is too large so that it is hard to acquire the operation and advantages of the present invention conventionally. This is because, as apparent from $L_e=k\cdot L_o$, when the coupling coefficient k is too large, $L_e$ becomes too small. However, as $L_o$ is made larger by changing the secondary winding to a thinner winding (0.03Φ to 0.035Φ) than the conventional one (0.04Φ to 0.06Φ) and winding a greater number of turns, $L_e$ becomes greater in proportion, thereby yielding a practical value for the leakage inductance $L_e$ or $L_s$.

With the JIS standard shape, the self-resonance frequency $f_p$ becomes too high, so that the self-resonance frequency $f_p$ should be lowered. The self-resonance frequency $f_p$ can be reduced by making the gap larger to reduce the effective permeability, and increasing the number of turns of the secondary winding or reducing the number of the sections. However, reducing the number of the sections decreases the breakdown voltage of the winding and is not practical. In any case, the JIS standard EE or EI core shape inevitably makes the transformer too thick and does not meet the market demands and makes it difficult to create a transformer larger than a certain size for lighting a cold-cathode fluorescent lamp. It is therefore effective to connect a plurality of middle-sized or smaller transformers.

If the size and shape of a high-power transformer are matched with the market demands, the transformer would have a flat shape and the length of the magnetic path with respect to the cross-sectional area of the core becomes too long. In this case, the coupling coefficient becomes too small. As the effective magnetic permeability is low, the number of winding turns should be increased, making the self-resonance frequency too low. If the number of sections is increased to make the self-resonance frequency higher, the leakage inductance becomes too large.

Figure 17:
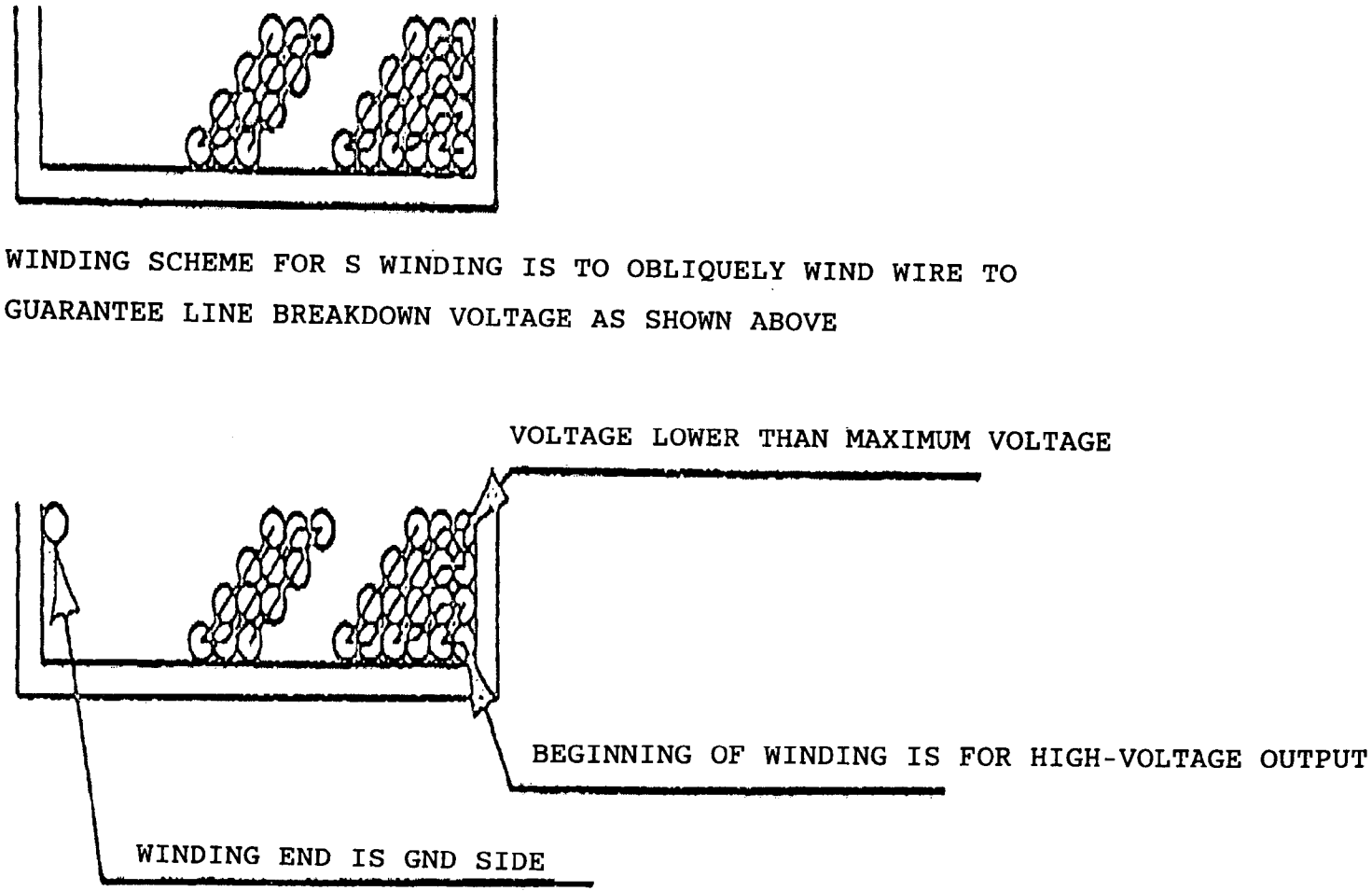
FIG. 17 is a cross-sectional view of an essential portion showing one example of the structure where the secondary winding is wound obliquely.
Figure 18:
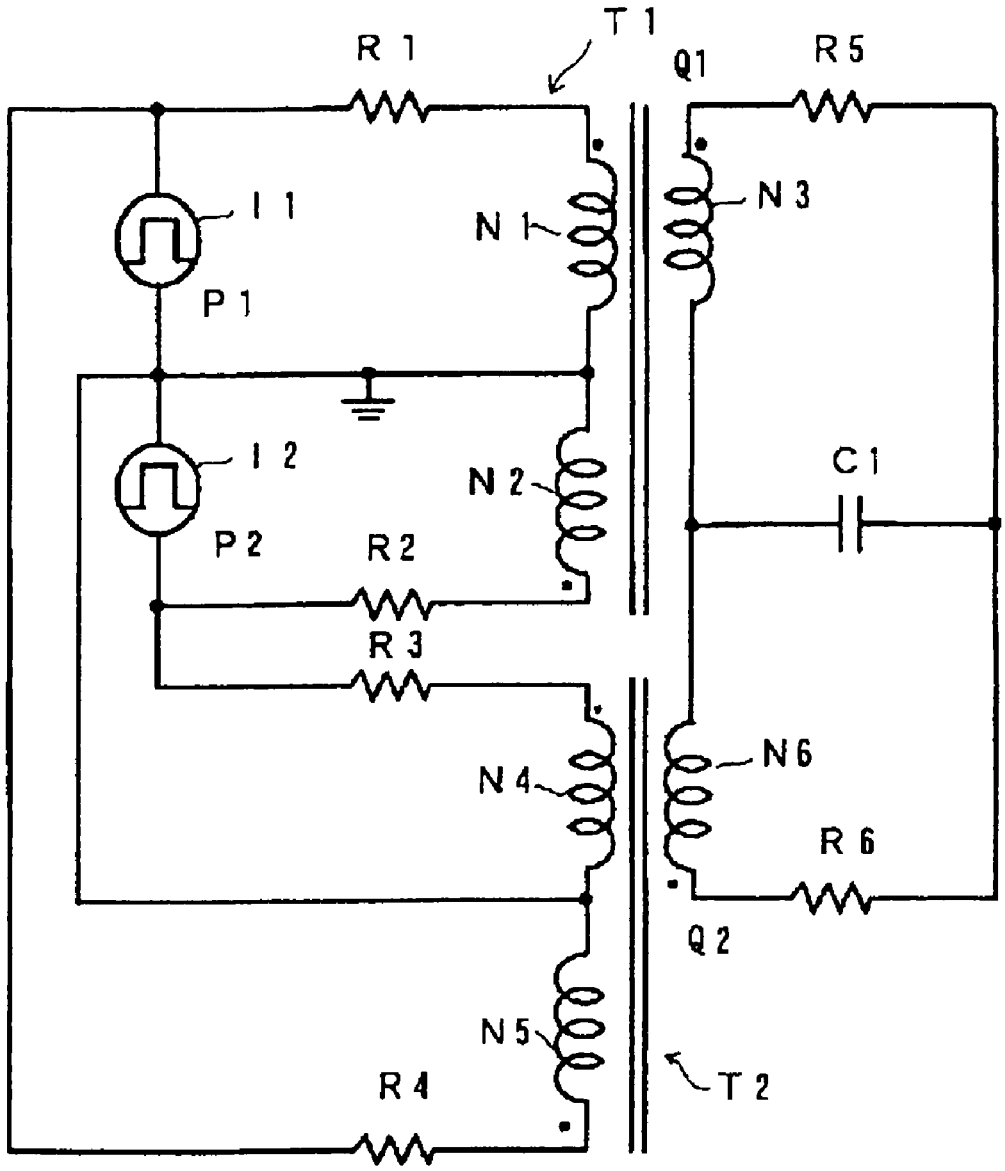
Fig. 18 Conventional Art
FIG. 18 is a circuit structural diagram exemplifying a discharge lamp to be pulse-driven, which is disclosed in Japanese Laid-Open Patent Publication (Kokai) No. 2000-138097.
Figure 19:
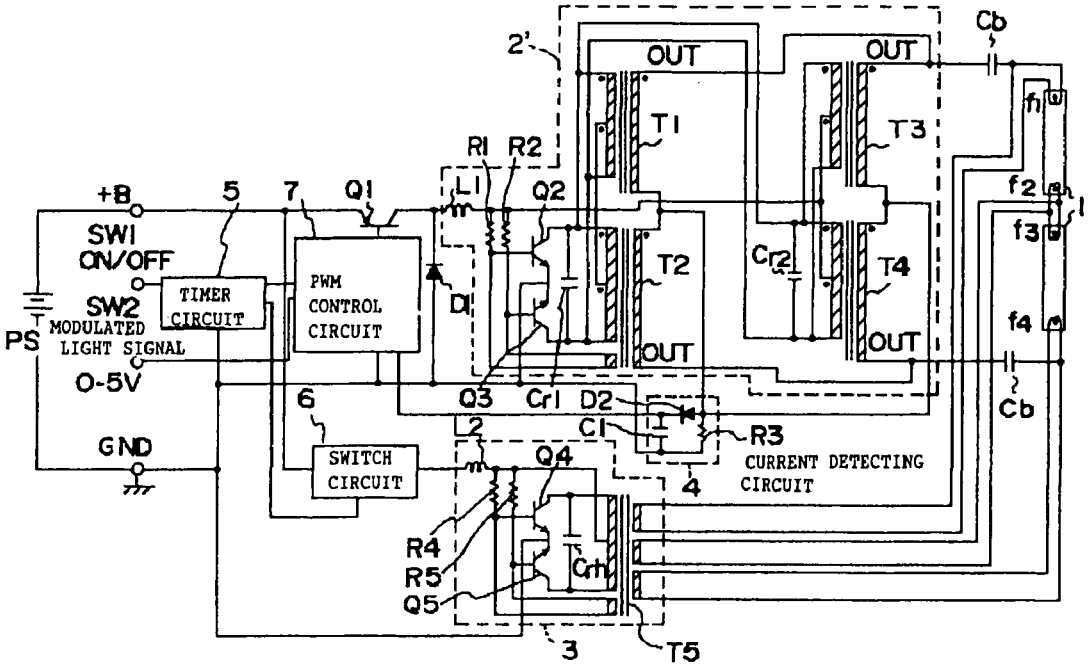
Fig. 19 Conventional Art
FIG. 19 is a circuit structural diagram showing one example of parallel connection disclosed in Japanese Laid-Open Patent Publication (Kokai) No. H10-92589.
Figure 20:
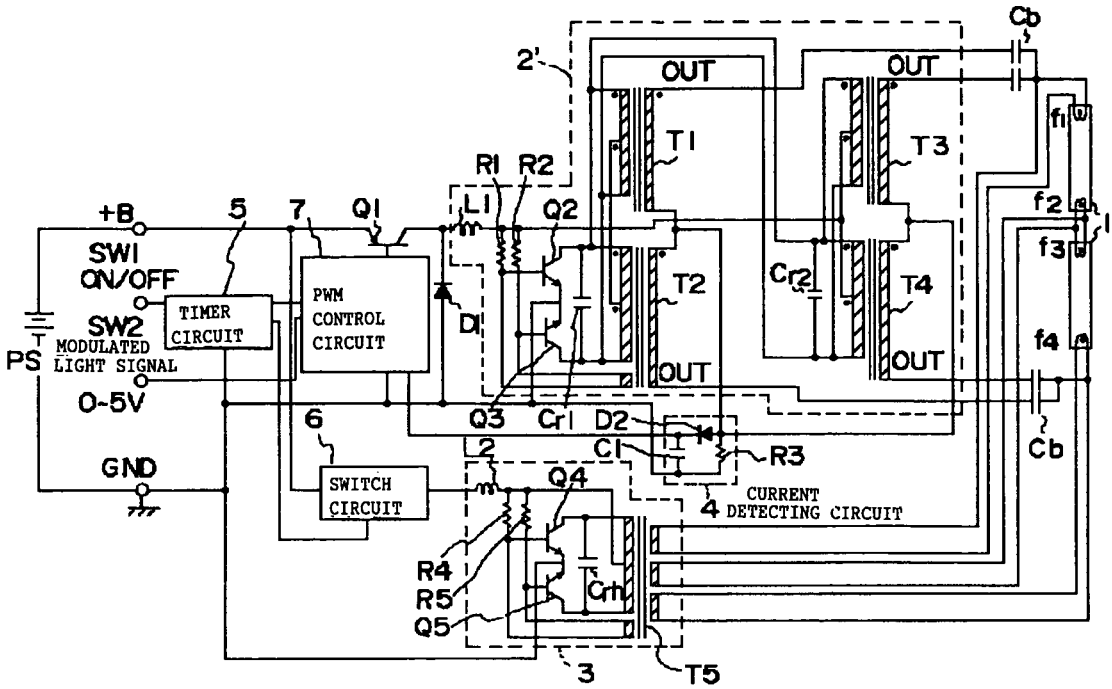
FIG. 20 is a structural diagram of an inverter circuit where the secondary windings are connected in parallel via ballast capacitors.

To overcome those shortcomings, therefore, it is effective to apply oblique winding shown in FIG. 17 to the secondary winding, as disclosed in U.S.P. 2002/0140538 and Japanese Patent Nos. 2727461 and 2727462, and combine the oblique winding with subject matters recited in the appended claims 1 to 4 of the present invention.

This method can make the self-resonance frequency higher and coupling coefficient larger, so that even if a flat shape is taken, selection of conditions becomes more flexible and an inverter circuit can be designed freely.

The invention is the only way to achieve the thickness of 10 mm to 13 mm or less which is demanded in the market at present and realize a high-power transformer of 40 W to 60 W.

What is claimed is:

1. An inverter circuit for discharge lamps, comprising:

a plurality of leakage flux step-up transformers each having a magnetically continuous central core, a primary winding, and a distributed-constant secondary winding, wherein a part of a resonance circuit is formed among a leakage inductance produced on the secondary winding side, a distributed capacitance of said secondary winding and a parasitic capacitance produced around a discharge lamp close to a proximity conductor, and as said resonance circuit resonates, said secondary winding has a close coupling portion in a vicinity of said primary winding which has a magnetic phase close to that of said primary winding and magnetically close couples with said primary winding and where a large portion of a magnetic flux produced under said primary winding penetrates, and a loose coupling portion distant from said primary winding which has a magnetic phase delayed form that of said primary winding and where a large portion of said magnetic flux produced under said primary winding leaks, wherein a first end of each of the secondary windings is connected to a first end of each of a plurality of discharge lamps, whereby the plurality of discharge lamps are lighted in parallel.

2. The inverter circuit according to claim 1, wherein a standing wave generated on said distributed-constant secondary winding is reduced by matching a characteristic impedance of said distributed-constant secondary winding with impedances of said discharge lamps.

3. The inverter circuit according to claim 1 or 2, wherein said core of said step-up transformer has such a shape that a length of a magnetic path is shorter than a cross-sectional area of said magnetic path and said leakage inductance is increased by increasing the number of turns of said secondary winding.

4. The inverter circuit according to claim 1, wherein said secondary windings of said step-up transformers are connected in parallel.

5. The inverter circuit according to claim 1, wherein said secondary winding of each of said step-up transformers is obliquely wound.

6. The inverter circuit according to claim 1, wherein a second end of each of the secondary windings is directed connected to ground.

7. The inverter circuit according to claim 1, wherein a second end of each of the discharge lamps is connected to a shunt circuit.

8. The inverter circuit according to claim 1, wherein the secondary windings are connected in parallel.

9. The inverter circuit according to claim 1, further comprising an auxiliary capacitor for adjusting a frequency of the resonance circuit.

* * * * *